US005666142A

United States Patent [19]

Fujita et al.

[11] Patent Number: 5,666,142

[45] Date of Patent: Sep. 9, 1997

[54] INK JET RECORDING SYSTEM HAVING IMPROVED FUNCTIONAL DEVICES FOR DRIVING ENERGY GENERATING MEMBERS

[75] Inventors: Kei Fujita, Kokubunji; Asao Saito, Yokohama; Shigeyuki Matsumoto, Atsugi, all of Japan

[73] Assignee: Canon Kabushiki Kaisha, Tokyo, Japan

[21] Appl. No.: 255,899

[22] Filed: Jun. 7, 1994

Related U.S. Application Data

[63] Continuation of Ser. No. 106,164, Dec. 28, 1992, abandoned, which is a continuation of Ser. No. 646,290, Jan. 28, 1991, abandoned.

[30] Foreign Application Priority Data

Jan. 31, 1990 [JP] Japan ..... 2-19320

[51] Int. Cl.[6] ..... B41V 2/05

[52] U.S. Cl. ..... 347/59; 257/337; 438/21

[58] Field of Search ..... 347/59, 209, 210, 347/211; 257/344, 408, 409, 337, 343; 437/34, 58

[56] References Cited

U.S. PATENT DOCUMENTS

| | | | |
|---|---|---|---|
| 4,173,818 | 11/1979 | Rassous | 437/44 |
| 4,280,855 | 7/1981 | Bertin | 148/1.5 |
| 4,288,801 | 9/1981 | Ronen | 347/59 X |
| 4,313,684 | 2/1982 | Tazaki | 347/37 X |
| 4,429,321 | 1/1984 | Matsumoto | 347/59 |
| 4,573,066 | 2/1986 | Whight | 257/495 |
| 4,618,872 | 10/1986 | Baliga . | |
| 4,719,477 | 1/1988 | Hess | 347/59 |
| 4,743,955 | 5/1988 | Matsumoto | 257/435 |
| 4,794,443 | 12/1988 | Tanaka et al. | 257/446 |
| 4,814,846 | 3/1989 | Matsumoto et al. | 257/446 |
| 4,816,889 | 3/1989 | Matsumoto | 257/448 |
| 4,887,098 | 12/1989 | Hawkins | 347/58 |
| 4,924,112 | 5/1990 | Anderson . | |
| 4,947,192 | 8/1990 | Hawkins | 347/59 |
| 4,968,639 | 11/1990 | Bergonzoni | 437/57 |
| 5,055,896 | 10/1991 | Williams | 254/344 X |
| 5,081,474 | 1/1992 | Shibata | 347/59 |
| 5,216,447 | 6/1993 | Fujita | 347/59 |

FOREIGN PATENT DOCUMENTS

| | | | |
|---|---|---|---|
| 369347 | 10/1989 | European Pat. Off. | B41J 2/335 |
| 401440 | 12/1990 | European Pat. Off. | B41J 2/05 |

OTHER PUBLICATIONS

Ohr, Stephan; DMOS–CMOS Process Points . . . ; Electronic Design, Feb. 9, 1984, pp. 37–38.

Choy et al.; A High–Voltage Chip Set . . . ; Proceedings of the SID, vol. 22/3, 1982 pp. 187–196.

*Primary Examiner*—Joseph W. Hartary

*Attorney, Agent, or Firm*—Fitzpatrick, Cella, Harper & Scinto

[57] ABSTRACT

A recording head comprises electrothermal transducers for jetting ink and functional devices for driving these electrothermal transducers, both of which are arranged on a single substrate plate. The functional devices comprise a pair of major electrode regions such as drain and source regions arranged on the substrate plate, a region comprising control electrode region and surrounding one of electrode regions used to be grounded, an insulating layer arranged on the control electrode region and a control electrode arranged on the insulating layer. The control layer alters the semiconductor types of a boundary surface of the control electrode region by applying a control voltage through the insulating layer and as a result a current flow between major electrode regions, source and drain, is controlled.

22 Claims, 11 Drawing Sheets

INK JET RECORDING SYSTEM HAVING IMPROVED FUNCTIONAL DEVICES FOR DRIVING ENERGY GENERATING MEMBERS

This application is a continuation of application Ser. No. 08/106,164 filed Dec. 28, 1992, now abandoned, which is a continuation of application Ser. No. 07/646,290 filed Jan. 28, 1991, now abandoned.

BACKGROUND OF THE INVENTION

1. Field of the Invention

The present invention relates to an ink jet recording system used for copying machines, facsimile apparatuses, word processors, printers as an output terminal for a work station, personal computers, host computers or optical disc apparatuses, video output printers, handy or portable printers to be coupled to the above-described equipment or the like and more particularly to a substrate for a recording head where an electrothermal transducer which generates a thermal energy used for recording information and functional devices for recording are configurated on the common substrate plate, a recording head, an ink jet recording system and a method of manufacturing the substrate.

RELATED BACKGROUND ART

Conventionally, recording heads generally have the following structures. Electrothermal transducers are arranged in an array geometry and formed on a single crystal silicon substrate plate. A driver circuit for driving the electrothermal transducers is formed outside the silicon substrate plate by arranging functional devices such as transistor arrays and/or diode arrays. Electric connections between the electrothermal transducers and the functional devices such as transistors arrays are made by flexible cables, wire bonding or the like.

On the other hand, for the purpose of simplification of a structure of the above-mentioned recording head, reduction of the defective components during manufacturing processes, and improvements of uniformity of characteristics of electronic devices and reproducibility of the device, developed was an ink jet recording head having electrothermal transducers and functional devices, both of which are formed on the common substrate plate, such as disclosed in Japanese Patent Application Laying-open No. 72867/1982. U.S. Pat. No. 4,429,311 has foreign priority based at least in part on the Japanese patent application from which the aforementioned Japanese document matured.

FIG. 1 shows a part of a recording head formed on a common substrate plate. Reference numeral 901 denotes a semiconductor substrate plate formed by a single crystal silicon. Reference numeral 902 denotes an N type semiconductor collector region. Reference numeral 903 denotes an ohmic contact region of N type semiconductor containing a high impurity concentration. Reference numeral 904 denotes a base region of P type semiconductor. Reference numeral 905 denotes an emitter region of N type semiconductor containing a high impurity concentration. The regions 901 to 905 define a bipolar transistor 920. Reference numeral 906 denotes a silicon oxide layer as a heat accumulating and insulating layer. Reference numeral 907 denotes a boron hafnium layer as a heating resistance layer. Reference numeral 908 denotes an aluminium electrode. Reference numeral 909 denotes a silicon oxide layer as a protective layer. The regions 901 to 909 form a substrate 930 for a recording head. In the layer configuration shown in FIG. 1, reference numeral 940 denotes a heating portion. A top plate 910 defines a liquid passage (ink passage) 950 in cooperation with the substrate 930.

A lot of improvements and proposals have been made with respect to the recording head having the structures mentioned above. Recently, specific performance improvements have been further required in the recording head, such as attaining higher speed driveability, saving energy consumption, higher integration density, lower cost, higher reliability and high level functionality. Accordingly, in order to provide a recording head with a reduced chip size, higher density integration of functional devices for driving electrothermal transducers, higher performances, higher recording ability and a lower cost, the structure of the recording head can be formed in the form of an MOS transistor array, as shown in FIG. 2A and FIG. 2B, for instance.

That is, the MOS transistor arrays are provided on a semiconductor substrate plate 1. By driving these MOS transistors in array geometry sequentially or by driving some of them concurrently, a connection in a matrix geometry and electric separability between the respective electrothermal transducers can be established.

However, in case of using a large amount of an electric current required for driving the electrothermal transducers, by way of driving conventional MOS transistor arrays, a P-n reverse-biased portion on junction region between a drain and a well cannot withstand the high intensity electric field generated there and occurs a leakage current. Thus, the conventional MOS transistor arrays cannot adequately satisfy a withstand voltage required for functional devices for driving the electrothermal transducers. Moreover, because a large amount of current is supplied into the MOS transistors, there is such a problem to be solved that an enough amount of current required for driving the electrothermal transducers cannot be obtained due to a wasteful consumption of current in the MOS transistors, in case that an ON resistance of the MOS transistors is high.

SUMMARY OF THE INVENTION

It is an object of this present invention to provide a substrate for a recording head having a plurality of functional devices for driving a plurality of energy generating members such as a plurality of electrothermal transducers at the high speed action with a large amount of current supplied and a high withstand voltage as well as attain saving energy consumption, higher density integration and lower cost so as to solve the problems described above.

It is another object of the present invention to provide a recording head having the above substrate.

It is a further object of the present invention to provide an ink jet recording system having the recording head.

It is still a further object of the present invention to provide a method of manufacturing the substrate.

It is yet a further object of the present invention to provide a copying machine to which the ink jet recording system is equipped.

It is yet a further object of the present invention to provide a facsimile machine to which the ink jet recording system is equipped.

It is yet a further object of the present invention to provide a word processor to which the ink jet recording system is equipped.

It is yet a further object of the present invention to provide an optical disc apparatus to which the ink jet recording system is equipped.

It is yet a further object of the present invention to provide a work station to which the ink jet recording system is equipped.

It is yet a further object of the present invention to provide a personal or host computer to which the ink jet recording system is equipped.

It is yet a further object of the present invention to provide a portable or handy printer having the above-described recording head.

In the first aspect of the present invention, a substrate for a recording head comprises:

a substrate plate;

a fluid ejection outlet part including an ink ejection outlet;

a plurality of energy generating members for generating energies to be supplied to the ink so as to jet ink fed into the ejection outlet part; a plurality of functional devices connected electrically to the plurality of energy generating members for driving the plurality of energy generating members, the plurality of energy generating members and the plurality of functional devices being formed commonly on the substrate plate;

each of the plurality of functional devices including:

a pair of major electrode regions arranged to be separated from each other in a first conduction type semiconductor of a lower impurity concentration as the substrate plate, the pair of major electrode regions being composed of a second conduction type semiconductor;

a control electrode region so arranged to enclose one of the pair of major electrode regions, the one region being grounded, and the control electrode having a first conduction type semiconductor layer of a higher impurity concentration than the impurity concentration of the substrate plate;

an insulating layer arranged on the control electrode region; and control means for applying a control voltage to the control electrode through the insulating layer to change the conduction type in the vicinity of a boundary of the control electrode region into the second conduction type semiconductor, thereby controlling a current flowing between the pair of major electrode regions.

Here, the susbstrate may further comprise a guard ring region disposed between the functional devices, the guard ring region having the same conduction type semiconductor as the substrate plate and having a higher impurity concentration than the impurity concentration of the substrate plate.

The plurality of energy generating members may be a plurality of thermal transducers for generating thermal energies in correspondency with driving signals from the plurality of functional devices, the thermal energies cause film boiling in ink and thereby eject ink from the ink ejection outlet.

The plurality of energy generating members may be a plurality of thermal transducers for generating thermal energies in correspondency with driving signals from the plurality of functional devices, the thermal energies cause film boiling in ink and thereby eject ink from the ink ejection outlet.

In the second aspect of the present invention, a recording head comprises:

a substrate comprising:

a substrate plate;

a substrate for a recording head, comprising:

a fluid ejection outlet part including an ejection outlet;

a plurality of energy generating members for generating energies to be supplied to the ink so as to jet ink fed into the ejection outlet part;

a plurality of functional devices connected electrically to the plurality of energy generating members for driving the plurality of energy generating members, the plurality of electrothermal transducers and the plurality of functional devices being formed commonly on the substrate plate;

the functional devices including:

a pair of major electrode regions arranged to be separated from each other in a first conduction type semiconductor of a lower impurity concentration as the substrate plate, the pair of major electrode regions being composed of a second conduction type semiconductor.

Here, the recording head may further comprise a guard ring region disposed between the functional devices, the guard ring region having the same conduction type semiconductor as the substrate plate and having a higher impurity concentration than the impurity concentration of the substrate plate.

The plurality of energy generating members may be a plurality of thermal transducers for generating thermal energies in correspondency with driving signals from the plurality of functional devices, the thermal energies cause film boiling in ink and thereby eject ink from the ink ejection outlet.

The plurality of energy generating members may be a plurality of thermal transducers for generating thermal energies in correspondency with driving signals from the plurality of functional devices, the thermal energies cause film boiling in ink and thereby eject ink from the ink ejection outlet.

Each of the control electrodes of the plurality of functional devices may be grounded.

Each of the control electrodes of the plurality of functional devices may be grounded.

In the third aspect of the present invention, an ink jet recording system comprises:

a recording head having a substrate;

the substrate including:

a substrate plate;

a fluid ejection outlet part including an ejection outlet a plurality of energy generating members for generating energies to be supplied to the ink so as to jet ink fed into the ejection outlet part;

a plurality of functional devices connected electrically to the plurality of energy generating members for driving the plurality of energy generating members the plurality of energy generating members and the plurality of functional devices being formed commonly on the substrate plate;

each of the plurality of functional devices including:

a pair of major electrode regions arranged to be separated from each other in a first conduction type semiconductor of a lower impurity concentration as the substrate plate, the pair of major electrode regions being composed of a second conduction type semiconductor;

a control electrode region so arranged to enclose one of the pair of major electrode regions, the one region being grounded, and the control electrode having a first conduction type semiconductor layer of a higher impurity concentration than the impurity concentration of the substrate plate;

an insulating layer arranged on the control electrode region; and control means for applying a control voltage to the control electrode through the insulating layer to change the conduction type in the vicinity of a boundary of the control electrode region into the second conduction type semiconductor, thereby controlling a current flowing between the pair of major electrode regions;

ink feed means for supplying ink into the recording head; and transport means for carrying a recording medium to a recording position of the recording head.

Here, the ink jet recording system may further comprise a guard ring region disposed between the functional devices, the guard ring region having the same conduction type semiconductor as the substrate plate and having a higher impurity concentration than the impurity concentration of the substrate plate.

The plurality of energy generating members may be a plurality of thermal transducers for generating thermal energies in correspondency with driving signals from the plurality of functional devices, the thermal energies cause film boiling in ink and thereby eject ink from the ink ejection outlet.

The plurality of energy generating members may be a plurality of thermal transducers for generating thermal energies in correspondency with driving signals from the plurality of functional devices, the thermal energies cause film boiling in ink and thereby eject ink from the ink ejection outlet.

Each of the control electrodes of the plurality of functional devices may be grounded.

In the fourth aspect of the present invention, in a method of fabricating a substrate for a recording head, which comprises the substrate including a substrate plate; a fluid ejection outlet part including an ejection outlet for jetting ink; a plurality of energy generating members for generating energies to be supplied to the ink so as to jet ink fed into the ejection outlet part; and a plurality of functional devices connected electrically to the plurality of energy generating members for driving the plurality of energy generating members, the plurality of energy generating members and the plurality of functional devices being formed commonly on the substrate plate, the method comprises the steps of:

preparing a first conduction type semiconductor of a lower impurity concentration as the substrate plate;

forming a high impurity concentration region of the first conduction type in the substrate plate, the high impurity concentration region having a higher impurity concentration than the impurity concentration of the substrate plate;

forming a pair of major electrode regions of a second conduction type semiconductor in the higher impurity concentration region and at a position remote from the high impurity concentration region in the substrate plate, the second conduction type being different from the first conduction type;

forming major electrodes on the pair of major electrode regions thereby providing a control electrode region between the major electrodes;

forming an insulating layer on the control electrode region; and forming an electrode for controlling a current flowing between the pair of major electrodes by applying a control voltage to the control electrode region through the insulating layer.

Here, the method may further comprise the step of forming a guard ring region between the functional devices, the guard ring region having the same conduction type semiconductor as the substrate plate and having a higher impurity concentration than the impurity concentration of the substrate plate.

The plurality of energy generating members may be a plurality of thermal transducers for generating thermal energies in correspondency with driving signals from the plurality of functional devices, the thermal energies cause film boiling in ink and thereby eject ink from the ink ejection outlet.

The plurality of energy generating members may be a plurality of thermal transducers for generating thermal energies in correspondency with driving signals from the plurality of functional devices, the thermal energies cause film boiling in ink and thereby eject ink from the ink ejection outlet.

The higher impurity concentration region and the major electrode region formed in the higher impurity concentration region may be formed by a double diffusion process.

The higher impurity concentration region and the major electrode region formed in the higher impurity concentration region may be formed by a double diffusion process.

In the fifth aspect of the present invention, a copying machine comprises:

an ink jet recording unit, comprising:

a recording head having a substrate;

the substrate including:

a substrate plate;

a fluid ejection outlet part including an ejection outlet for jetting ink;

a plurality of energy generating members for generating energies to be supplied to the ink so as to jet ink fed into the ejection outlet part;

a plurality of functional devices connected electrically to the plurality of energy generating members for driving the plurality of energy generating members, the plurality of energy generating members and the plurality of functional devices being formed commonly on the substrate plate;

each of the plurality of functional devices including:

a pair of major electrode regions arranged to be separated from each other in a first conduction type semiconductor of a lower impurity concentration as the substrate plate, the pair of major electrode regions being composed of a second conduction type semiconductor;

a control electrode region so arranged to enclose one of the pair of major electrode regions, the one region being grounded, and the control electrode having a first conduction type semiconductor layer of a higher impurity concentration than the impurity concentration of the substrate plate;

an insulating layer arranged on the control electrode region; and control means for applying a control voltage to the control electrode through the insulating layer to change the conduction type in the vicinity of a boundary of the control electrode region into the second conduction type semiconductor, thereby controlling a current flowing between the pair of major electrode regions;

ink feed means for supplying ink into the recording head;

transport means for carrying a recording medium to a recording position of the recording head;

means for controlling the plurality of functional devices in accordance with processed information to be recorded;

means for controlling the controlling means when recording is instructed;

means for controlling the ink feed means; and means for controlling the transport means.

In the sixth aspect of the present invention, a facsimile machine comprises:

an ink jet recording unit, comprising:

a recording head having a substrate;

the substrate including:

a substrate plate;

a fluid ejection outlet part including an ejection outlet for jetting ink;

a plurality of energy generating members for generating energies to be supplied to the ink so as to jet ink fed into the ejection outlet part;

a plurality of functional devices connected electrically to the plurality of energy generating members for driving the plurality of energy generating members, the plurality of energy generating members and the plurality of functional devices being formed commonly on the substrate plate;

each of the plurality of functional devices including:

a pair of major electrode regions arranged to be separated from each other in a first conduction type semiconductor of a lower impurity concentration as the substrate plate, the pair of major electrode regions being composed of a second conduction type semiconductor;

a control electrode region so arranged to enclose one of the pair of major electrode regions, the one region being grounded, and the control electrode having a first conduction type semiconductor layer of a higher impurity concentration than the impurity concentration of the substrate plate;

an insulating layer arranged on the control electrode region; and control means for applying a control voltage to the control electrode through the insulating layer to change the conduction type in the vicinity of a boundary of the control electrode region into the second conduction type semiconductor, thereby controlling a current flowing between the pair of major electrode regions;

ink feed means for supplying ink into the recording head;

transport means for carrying a recording medium to a recording position of the recording head;

means for controlling the plurality of functional devices in accordance with processed information to be recorded;

means for controlling the controlling means when recording is instructed;

means for controlling the ink feed means; and means for controlling the transport means.

In the seventh aspect of the present invention, a word processor comprises:

an ink jet recording unit, comprising:

a recording head having a substrate;

the substrate including:

a substrate plate;

a fluid ejection outlet part including an ejection outlet for jetting ink;

a plurality of energy generating members for generating energies to be supplied to the ink so as to jet ink fed into the ejection outlet part;

a plurality of functional devices connected electrically to the plurality of energy generating members for driving the plurality of energy generating members, the plurality of energy generating members and the plurality of functional devices being formed commonly on the substrate plate;

each of the plurality of functional devices including:

a pair of major electrode regions arranged to be separated from each other in a first conduction type semiconductor of a lower impurity concentration as the substrate plate, the pair of major electrode regions being composed of a second conduction type semiconductor;

a control electrode region so arranged to enclose one of the pair of major electrode regions, the one region being grounded, and the control electrode having a first conduction type semiconductor layer of a higher impurity concentration than the impurity concentration of the substrate plate;

an insulating layer arranged on the control electrode region; and control means for applying a control voltage to the control electrode through the insulating layer to change the conduction type in the vicinity of a boundary of the control electrode region into the second conduction type semiconductor, thereby controlling a current flowing between the pair of major electrode regions;

ink feed means for supplying ink into the recording head;

transport means for carrying a recording medium to a recording position of the recording head;

means for controlling the plurality of functional devices in accordance with processed information to be recorded;

means for controlling the controlling means when recording is instructed;

means for controlling the ink feed means; and means for controlling the transport means.

In the eighth aspect of the present invention, an optical disc apparatus comprises:

an ink jet recording unit, comprising:

a recording head having a substrate; the substrate including:

a substrate plate;

a fluid ejection outlet part including an ejection outlet for jetting ink;

a plurality of energy generating members for generating energies to be supplied to the ink so as to jet ink fed into the ejection outlet part;

a plurality of functional devices connected electrically to the plurality of energy generating members for driving the plurality of energy generating members, the plurality of energy generating members and the plurality of functional devices being formed commonly on the substrate plate;

each of the plurality of functional devices including:

a pair of major electrode regions arranged to be separated from each other in a first conduction type semiconductor of a lower impurity concentration as the substrate plate, the pair of major electrode regions being composed of a second conduction type semiconductor;

a control electrode region so arranged to enclose one of the pair of major electrode regions, the one region being grounded, and the control electrode having a first conduction type semiconductor layer of a higher impurity concentration than the impurity concentration of the substrate plate;

an insulating layer arranged on the control electrode region; and control means for applying a control voltage to the control electrode through the insulating layer to change the conduction type in the vicinity of a boundary of the control electrode region into the second conduction type semiconductor, thereby controlling a current flowing between the pair of major electrode regions;

ink feed means for supplying ink into the recording head;

transport means for carrying a recording medium to a recording position of the recording head;

means for controlling the plurality of functional devices in accordance with processed information to be recorded;

means for controlling the controlling means when recording is instructed;

means for controlling the ink feed means; and means for controlling the transport means.

In the ninth aspect of the present invention, a work station comprises:

an ink jet recording unit, comprising:

a recording head having a substrate;

the substrate including:

a substrate plate;

a fluid ejection outlet part including an ejection outlet for jetting ink;

a plurality of energy generating members for generating energies to be supplied to the ink so as to jet ink fed into the ejection outlet part;

a plurality of functional devices connected electrically to the plurality of energy generating members for driving the plurality of energy generating members, the plurality of energy generating members and the plurality of functional devices being formed commonly on the substrate plate;

each of the plurality of functional devices including:

a pair of major electrode regions arranged to be separated from each other in a first conduction type semiconductor of a lower impurity concentration as the substrate plate, the pair of major electrode regions being composed of a second conduction type semiconductor;

a control electrode region so arranged to enclose one of the pair of major electrode regions, the one region being grounded, and the control electrode having a first conduction type semiconductor layer of a higher impurity concentration than the impurity concentration of the substrate plate;

an insulating layer arranged on the control electrode region; and control means for applying a control voltage to the control electrode through the insulating layer to change the conduction type in the vicinity of a boundary of the control electrode region into the second conduction type semiconductor, thereby controlling a current flowing between the pair of major electrode regions;

ink feed means for supplying ink into the recording head;

transport means for carrying a recording medium to a recording position of the recording head;

means for controlling the plurality of functional devices in accordance with processed information to be recorded;

means for controlling the controlling means when recording is instructed;

means for controlling the ink feed means; and means for controlling the transport means.

In the tenth aspect of the present invention, a computer comprises:

an ink jet recording unit, comprising:

a recording head having a substrate;

the substrate including:

a substrate plate;

a fluid ejection outlet part including an ejection outlet for jetting ink;

a plurality of energy generating members for generating energies to be supplied to the ink so as to jet ink fed into the ejection outlet part;

a plurality of functional devices connected electrically to the plurality of energy generating members for driving the plurality of energy generating members, the plurality of energy generating members and the plurality of functional devices being formed commonly on the substrate plate;

each of the plurality of functional devices including:

a pair of major electrode regions arranged to be separated from each other in a first conduction type semiconductor of a lower impurity concentration as the substrate plate, the pair of major electrode regions being composed of a second conduction type semiconductor;

a control electrode region so arranged to enclose one of the pair of major electrode regions, the one region being grounded, and the control electrode having a first conduction type semiconductor layer of a higher impurity concentration than the impurity concentration of the substrate plate;

an insulating layer arranged on the control electrode region; and control means for applying a control voltage to the control electrode through the insulating layer to change the conduction type in the vicinity of a boundary of the control electrode region into the second conduction type semiconductor, thereby controlling a current flowing between the pair of major electrode regions;

ink feed means for supplying ink into the recording head;

transport means for carrying a recording medium to a recording position of the recording head;

means for controlling the plurality of functional devices in accordance with processed information to be recorded;

means for controlling the controlling means when recording is instructed;

means for controlling the ink feed means; and means for controlling the transport means.

In the eleventh aspect of the present invention, a portable printer comprises:

an ink jet recording unit, comprising:

a recording head having a substrate;

the substrate including:

a substrate plate;

a fluid ejection outlet part including an ejection outlet for jetting ink;

a plurality of energy generating members for generating energies to be supplied to the ink so as to jet ink fed into the ejection outlet part;

a plurality of functional devices connected electrically to the plurality of energy generating members for driving the plurality of energy generating members, the plurality of energy generating members and the plurality of functional devices being formed commonly on the substrate plate;

each of the plurality of functional devices including:

a pair of major electrode regions arranged to be separated from each other in a first conduction type semiconductor of a lower impurity concentration as the substrate plate, the pair of major electrode regions being composed of a second conduction type semiconductor;

a control electrode region so arranged to enclose one of the pair of major electrode regions, the one region being grounded, and the control electrode having a first conduction type semiconductor layer of a higher impurity concentration than the impurity concentration of the substrate plate;

an insulating layer arranged on the control electrode region; and control means for applying a control voltage to the control electrode through the insulating layer to change the conduction type in the vicinity of a boundary of the control electrode region into the second conduction type semiconductor, thereby controlling a current flowing between the pair of major electrode regions;

ink feed means for supplying ink into the recording head;

transport means for carrying a recording medium to a recording position of the recording head;

means receiving processed information to be recorded from an external utilizing apparatus for controlling the plurality of functional devices in accordance with the processed information; and means receiving controlling data from the external utilizing apparatus for controlling the ink feed means and the transport means in accordance with the controlling data.

In the present invention, for example, in case of MOS transistor arrays used as functional devices arranged and connected in a matrix geometry for driving electrothermal transducers as energy generating members, by forming a source region (which is one major electrode region used to be grounded) with a connection type opposite to that of a substrate plate on the semiconductor substrate plate with a low impurity concentration, and by forming a switching channel region (a voltage control region) with a conduction type identical with the substrate plate to surround the source region by double diffusion precess, a structure composed of drain—low impurity substrate plate—short channel—source region can be obtained. By using this structure, in the present invention, the above problems to be solved in relation to a withstand voltage and an ON resistance of the MOS transistor arrays can be solved with a minimum amount of increased steps in manufacturing processes. Therefore the present invention can provide a substrate for recording head, the recording head, and an ink jet recording system comprising functional devices for driving electrothermal transducers working the high speed with a large amount of current supplied and a high withstand voltage as well as attaining energy consumption savings, higher density integration and lower cost.

That is, owing to making a P type channel region to surround an $n^+$ source region, by minimizing amount of increased steps in manufacturing processes, it is possible to attain a higher withstand voltage in a P-n reverse-biased portion on junction region between a drain and a well under enough impressed voltage for driving heating elements, and also a large amount of current supplied, the high speed response, higher density integration or the like. The present invention can provide then a highly functional and stabilized substrate for a recording head, the recording head and an ink jet recording system. According to the present invention, by reason of making both the MOS transistor functional devices and the electrothermal transducers as energy generating members on the common substrate plate, it is possible to form a plurality of semiconductor devices with characteristics of a high withstand voltage and with good electric separability between each device on the single substrate plate. For example, in building a circuit in which devices are arranged and connected in a matrix geometry, there is no need to connect individually each electrothermal transducer via wiring cables to outside driving devices, and it is possible to reduce the wiring process among the overall manufacturing processes. Then, it is possible to reduce the number of fault occurrence and attain a higher reliability of the fabricated recording heads.

The above and other objects, effects, features and advantages of the present invention will become more apparent from the following description of embodiments thereof taken in conjunction with the accompanying drawings.

BRIEF DESCRIPTION OF THE DRAWINGS

Embodiments of the invention will now be described, by way of example, and with reference to the accompanying drawings in which.

DESCRIPTION OF THE PREFERRED EMBODIMENTS

Figure 1:
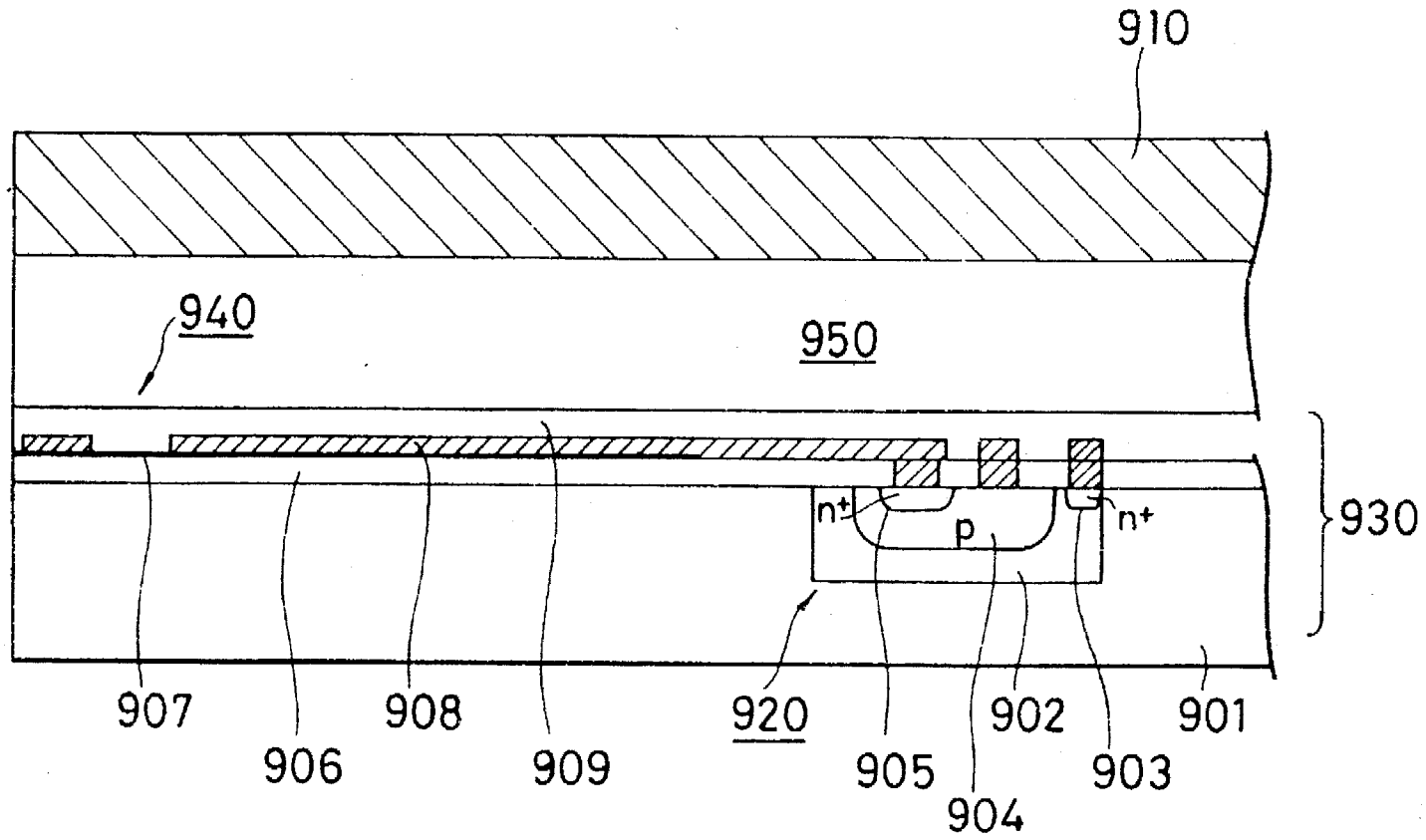
FIG. 1 PRIOR ART
FIG. 1 is a schematic sectional view showing a recording head showing a technology related to the present invention and illustrating the comparison with a recording head of the present invention.
Figure 2A:
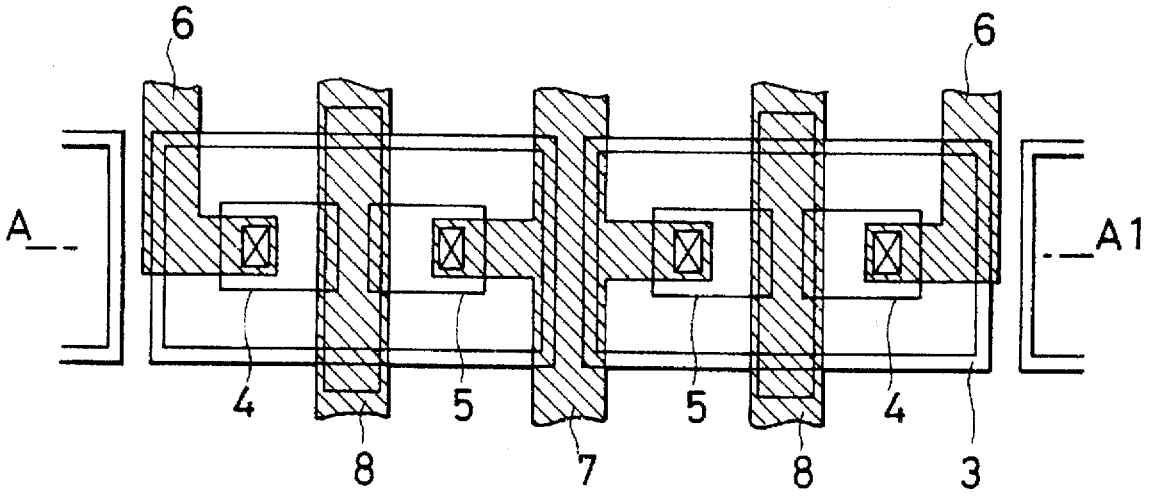
FIG. 2A and FIG. 2B are, respectively, a plan view and a sectional view showing an MOS transistor array showing a technology related to the present invention and illustrating the comparison with an MOS transistor array of the present invention.
Figure 2B:
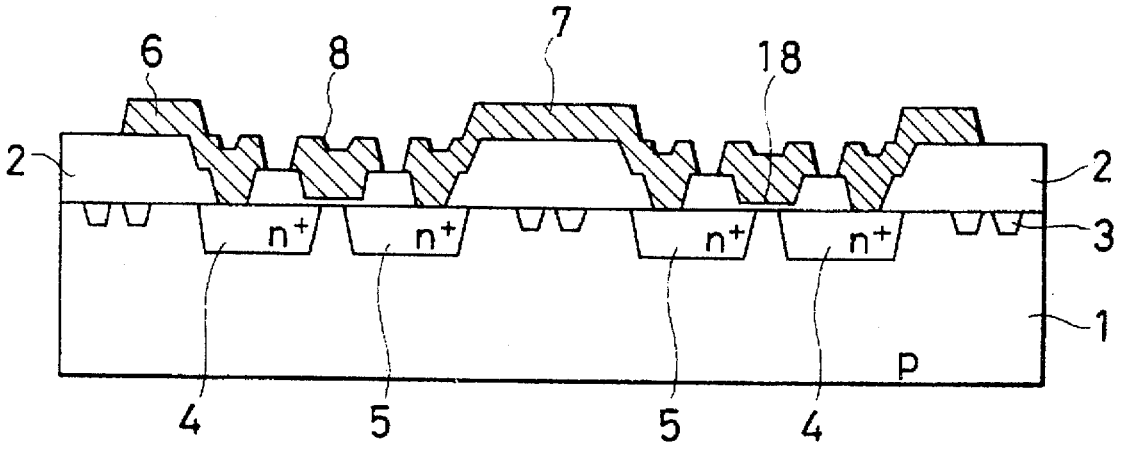

Throughout the following detailed description, similar reference numerals refer to similar elements in all figures of the drawings.

The present invention is not to be interpreted in a limiting sense, and may be adapted to various embodiments and modifications satisfying the purpose of the invention.

Figure 3A:
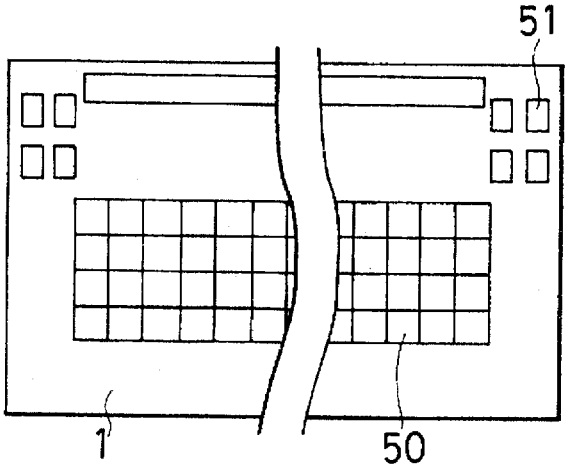
FIG. 3A is a schematic plan view showing one embodiment of a substrate for a recording head in accordance with the present invention.

FIG. 3A shows an embodiment of the present invention illustrating a substrate for the recording head using MOS transistor arrays as functional devices. Referring now to FIG. 3A, driving MOS transistors 50 are arranged in an array geometry on a silicon substrate plate 1, as well as temperature sensor diodes 51 are also arranged on the same substrate plate. All the inner structure of driving MOS transistors 50 are produced on the silicon substrate plate 1 by the masking processes. On the other hand, the temperature sensor diodes 51 are made on the silicon substrate plate 1 only by the diffusion process.

Next, in the present case, described are the basic structure and behavior of the MOS transistor array used as the functional devices for driving electrothermal transducers.

Figure 3B:
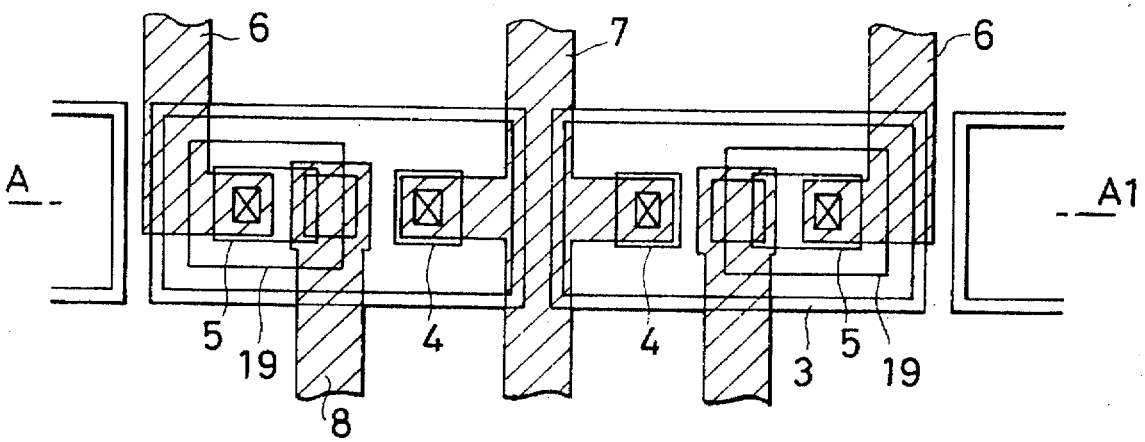
FIG. 3B is a plan view showing a structure of an MOS transistor array in one embodiment of a substrate in accordance with one embodiment of the present invention.
Figure 3C:
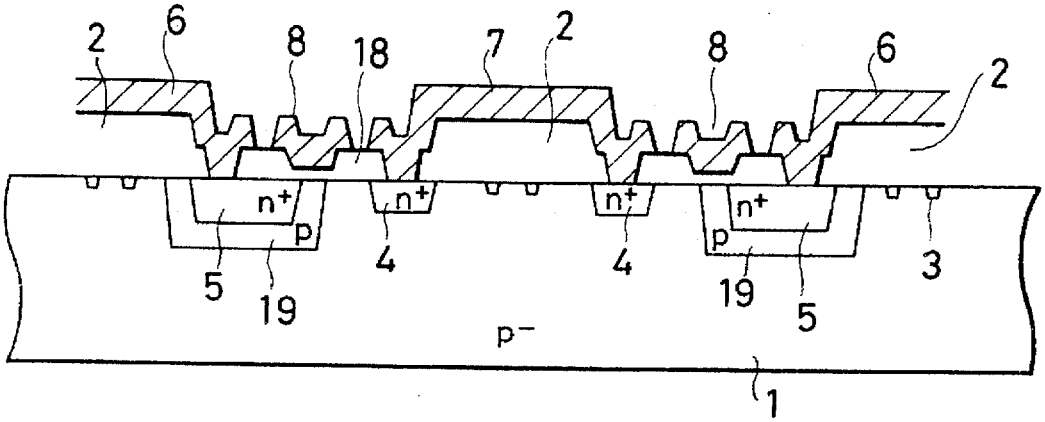
FIG. 3C is a vertical sectional view showing the MOS transistor array taken along line A-A1 in FIG. 3B.
Figure 3D:
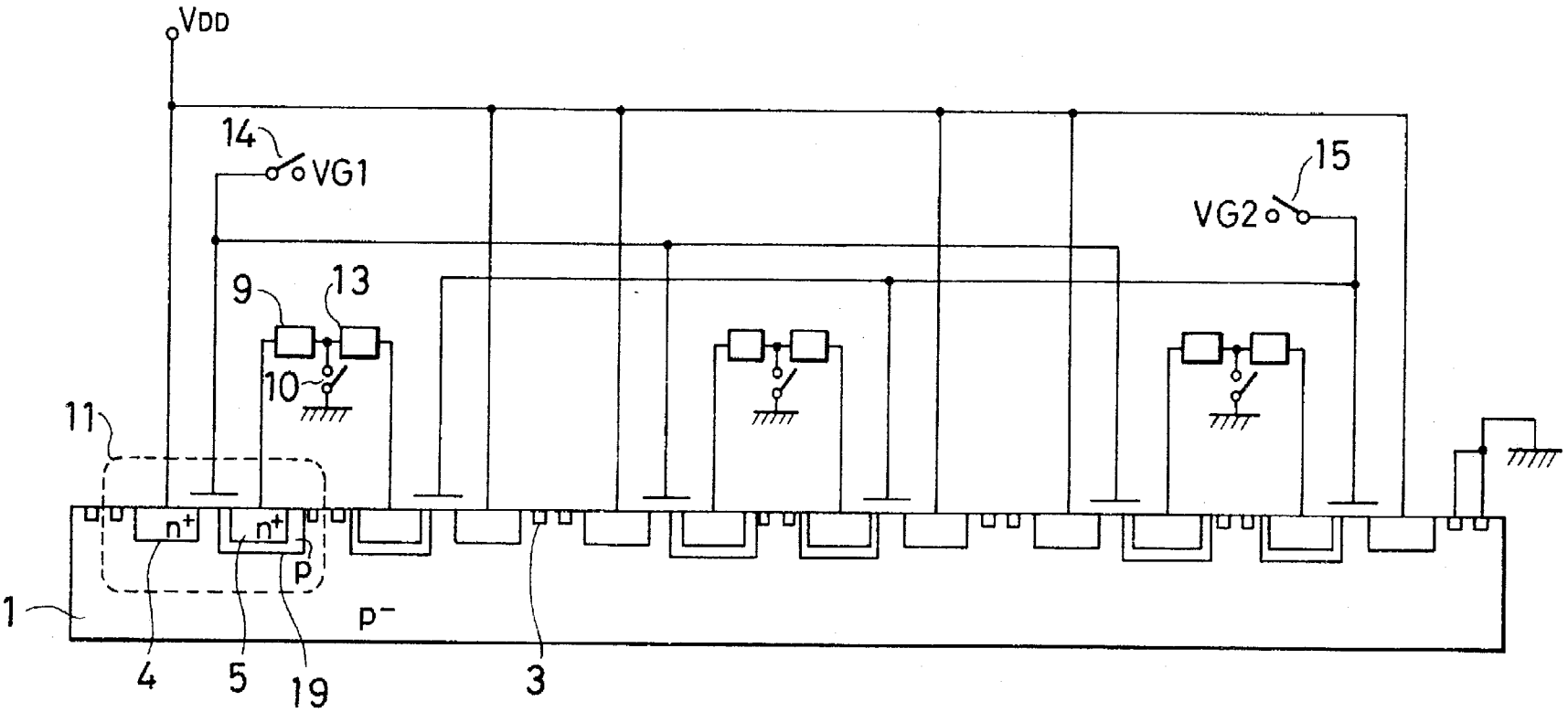
FIG. 3D is a connection diagram showing a connection of a driving circuit using the MOS transistor array shown in FIG. 3B and FIG. 3C.
Figure 3E:
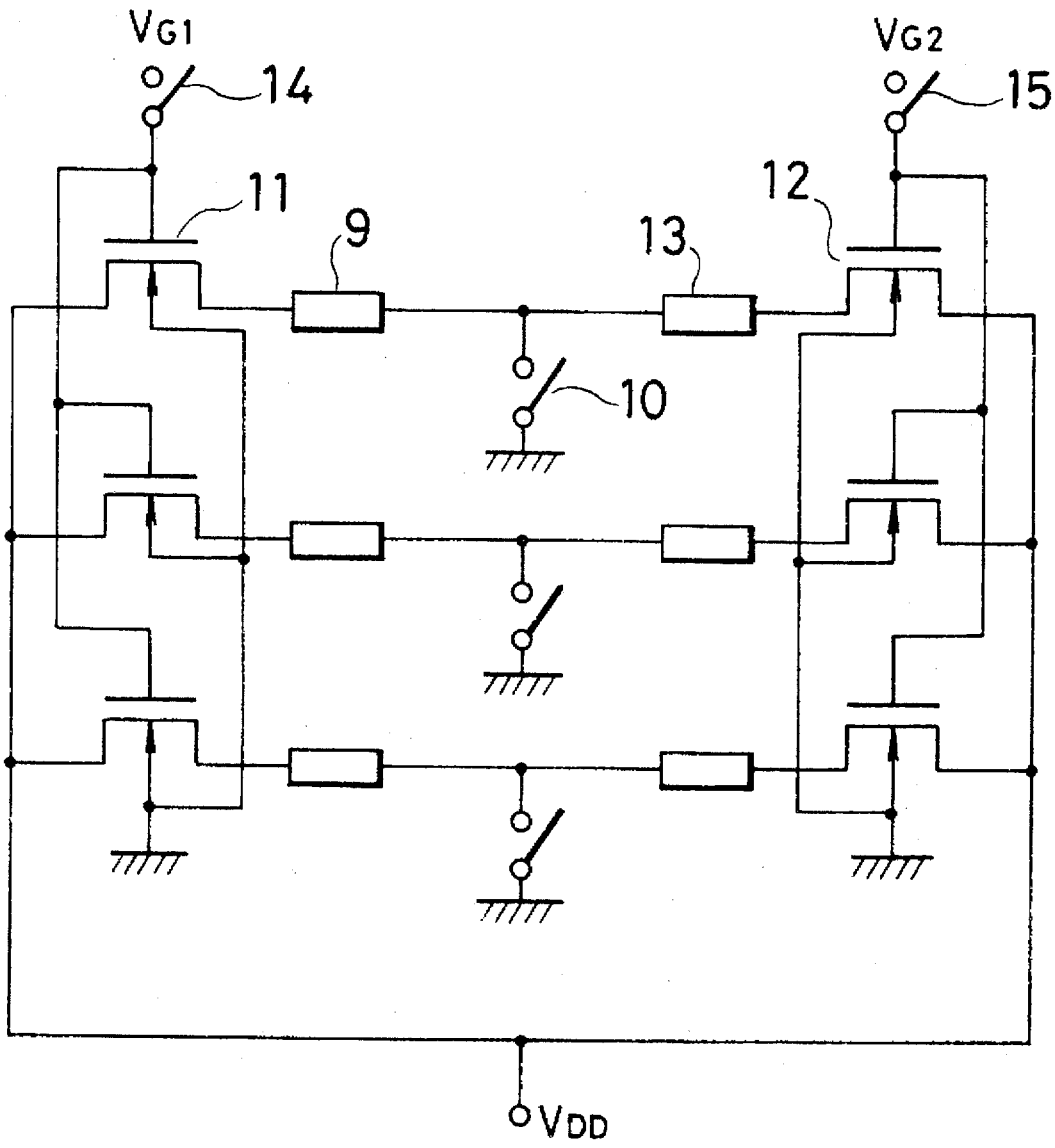
FIG. 3E is a circuit diagram showing an equivalent circuit to the circuit of the MOS transistor array shown in FIG. 3D.

FIG. 3B illustrates a plane structure of the MOS transistor array, FIG. 3C illustrates a vertical sectional structure of the MOS transistor array taken along line A-A1 in FIG. 3B, and FIG. 3D illustrates an example of connection in the MOS transistor array. FIG. 3E illustrates an equivalent circuit to the circuit of the MOS transistor array shown in FIG. 3D. In the FIG. 3B through FIG. 3E, similar reference numerals refer to similar elements.

The MOS transistor array of this embodiment is structured as shown in FIG. 3B and FIG. 3C. In FIG. 3B and FIG. 3C, reference numeral 1 denotes a $P^-$ type silicon substrate plate or base made by doping small amount of impurities such as boron or the like, and reference numeral 2 denotes an oxide insulating film made of silicon dioxide ($SiO_2$) film arranged on the substrate plate 1. Reference numeral 3 denotes a $P^+$ guard ring region containing high impurity concentration being formed by an impurity diffusion technology so that the region 3 is used to prevent a portion in the vicinity boundary of the silicon substrate plate 1 from turning into an N type semiconductor reacting with adjacent MOS transistors and also to establish an ohmic contact between the MOS transistor and the silicon substrate plate 1. Reference numerals 4 and 5 denote $n^+$ regions to define a drain and a source of the MOS transistor array, respectively being formed by, for example, the impurity diffusion technology, ion implantation technology or the like. Reference numeral 19 denotes a P type channel region being formed by a double diffusion process to surround the source region 5 being formed by the similar technology.

Reference numeral 6 denotes a source electrode made of conductive materials such as aluminum (Al), Al—Si, Al—Cu—Si or the like, connected to the $n^+$ source region 5. Reference numeral 7 denotes a drain electrode connected to the $n^+$ drain region 4. Reference numeral 8 denotes a gate electrode used as a common electrode of a capacitor for controlling a voltage applied to a control electrode region. The gate electrode 8 is also made of the conductive materials such as aluminum (Al), Al—Si, Al—Cu—Si or the like. Thus, the above mentioned MOS transistor array comprises the P type silicon substrate plate 1, the oxide film 2, the guard ring 3, the $n^+$ drain region 4, the $n^+$ source region 5, the P type channel region 19, the source electrode 6, the drain electrode 7 and the gate electrode 8.

The equivalent circuit illustrated in FIG. 3E is composed of the MOS transistors 11 and 12, segments 9 and 13 supplied an electric current and switches 10, 14 and 15. Referring to the equivalent circuit shown in FIG. 3E the following description, discloses a fundamental behavior of this circuit to supply the electric current individually into each segment of the electrothermal transducers to be controlled. In FIG. 3E, the drain electrode 7 of the each MOS transistor is forward-biased by positive voltage VDD. The silicon substrate plate 1 is grounded through the $n^+$ region on the silicon substrate plate. Under this state, the case of supplying an electric current only to the segment 9 is explained, for example, as follows. By closing the switch 10 and by biasing the gate electrode 8 through the switch 14 by a voltage more than its threshold voltage in order to form a channel, a current flows into the source electrode 6 of the MOS transistor 11, and then an electric current can be supplied to the segment 9.

An important aspect to be considered in the above case is to prevent the current flow running from the MOS transistor 11 to the adjacent MOS transistor, for example, the MOS transistor 12. If the gate voltage of the MOS transistor 12 is in the floating state, since the drain electrode 7 of the MOS transistor 12 is forward-biased by positive voltage VDD, the voltage induced by electrical noise in the capacitor formed with the gate electrode 8 and the silicon substrate plate 1 and the voltage induced by wiring capacitors in the circuit may be become greater than the threshold voltage of the MOS transistor 12. Thus, a channel is formed to flow into the MOS transistor 12, and an error behavior occurs such that an unnecessary current flow supplies and runs through the segment 13. In order to prevent such a mutual electric interference between adjacent MOS transistors, as shown in this embodiment, it is necessary to apply ground voltage to the gate electrode of the MOS transistor 12. That is, by making the switch 15 closed so as to clip the gate voltage VG2 into O V, it is possible to prevent a channel arranged just under the gate electrode, to prevent unnecessary turn on switching of the MOS transistors and to prevent adjacent MOS transistors from a mutual interfering electrically with each other.

Furthermore, in this embodiment, for the purpose of increasing the withstand voltage between source and drain regions, the P type channel region 19 surrounds the source region 5 containing high impurity concentration. Owing to this layout of regions, the concentration gradient becomes small value in the pn junction between source and drain regions where an electric field with a high intensity exists. As the source region 5 and the P type channel region 19 are formed by the double diffusion process, it is possible to make a region arranged the channel smaller, thereby it is also possible to reduce the ON resistance.

By making the drain electrodes of all the MOS transistors biased by an identical voltage and making the gate electrodes of all the MOS transistors applied by an identical gate voltage, it is possible to supply a current into a specified segment without adjacent MOS transistors interfering electrically with one another.

Next, referring now to FIG. 4A through FIG. 4D, a manufacturing process of a substrate for recording heads in this embodiment is described.

At first, prepared was a P type silicon substrate plate 1 with a P' conductivity type containing an impurity or element belonging in Group III of the periodic table such as boron, for example, the impurity concentration order was a concentration of $1\times10^{13}$ through $1\times10^{15}$ $cm^{-3}$. Next, on the P type silicon substrate plate 1, a masking oxide film 16 with its thickness of 5000 Å to 10000 Å was formed by a pylogenic oxidation process with $H_2$ and $O_2$, or by a wet oxidation process with $O_2$ and $H_2O$, or by a steam oxidation with $N_2$ and $H_2O$, or by a dry oxidation. In this case, a high pressure oxidation process at a temperature of 800 ° C. to 1000° C. was suited to obtain a qualified oxide film without stacking fault in the film so as to establish the oxide film 16.

Figure 4A:
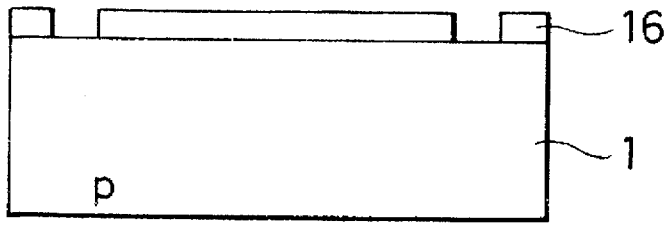
FIG. 4A through FIG. 4D are sectional views showing the MOS transistor array shown in FIG. 3B and FIG. 3C for illustrating one embodiment of a manufacturing process of the MOS transistor array in accordance with the present invention.

Next, the surface of the oxide film 16 was coated with a thin film of resist material and a region of the oxide film 16 corresponding to the guard ring 3 was removed selectively as shown in FIG. 4A.

Next, on the resultant wafer made of silicon substrate plate, an oxide film to be used as a buffer region with its thickness of 500 Å through 1500 Å was formed in an atmosphere of an oxidizing agent. After this process, the wafer was exposed to $B^+$ ion beam or $BF_2^+$ ion beam generated from $BF_3$ gas and then these ions were implanted in the wafer. In this case, the density implanted of ion was estimated to be, for example, $1\times10^{15}/cm^2$ through $2\times10^{16}/cm^2$.

The ion was implantion as described above, and subsequently by thermal diffusion of the ions in an atmosphere of $N_2$ gas and at the temperature of 1000 ° C. through 1100° C., the $P^+$ guard ring 3 was formed with its necessary depth into the silicon substrate plate 1. Next, the masking oxide film 16 was removed, for example, with a buffered hydrogen fluoride. In this case, the depth of the $P^+$ guard ring 3 was estimated, for example, to be 0.5 μm through 1.5 μm. The impurity concentration in the $P^+$ guard ring 3 was so adjusted that a portion near the surface of the silicon substrate plate 1 should not turn into an n-type silicon by the capacitor formed in the process described later between an oxide film and an electrode interconnection composed of a conductive material. As for the method of forming the guard ring 3, in addition to the above mentioned method, there is a method to form the guard ring 3 by depositing BSG (boron-silicate glass) on the wafer and then diffusing boron impurities into a necessary depth of The wafer by means of a thermal diffusion process at a temperature of 1100° C. through 1200° C.

Figure 4B:
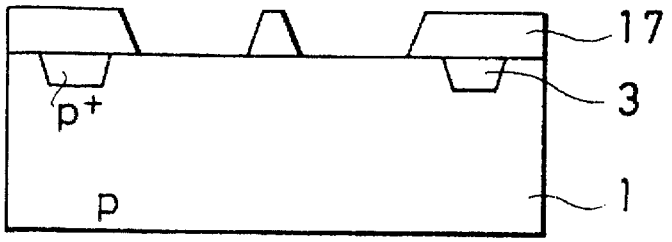

Next, an oxide film 17 with its thickness of 5000 Å through 10000 Å was formed on the wafer. The regions of the oxide film 17 corresponding to the source region 5, the drain region 4 and the P type channel region 19 were removed selectively as shown in FIG. 4B.

After that, an oxide film as a buffer region with its thickness of 500 Å through 1000 Å was formed on the wafer. This oxide film was established for the purpose of avoiding channelling and surface defects when forming then the source region 5, the drain region 4 and the P type channel region 19 by the ion implantation process. Moreover, the ionized boron impurities were implanted in the P channel region 19 with a resist mask and in the thermal diffusion process these impurities were diffused in the region 19.

Figure 4C:
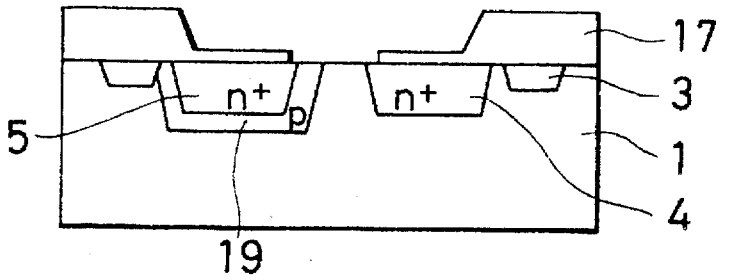

Next, by implanting the ionized impurities such as phosphorus ion or arsenic ion into the wafer, and by diffusing them based on the thermal diffusion process, the $n^+$ source region 5 and the $n^+$ drain region 4 were formed. And, in the mask alignment process and in the etching process, the gate region was partially removed as illustrated in FIG. 4C.

Figure 4D:
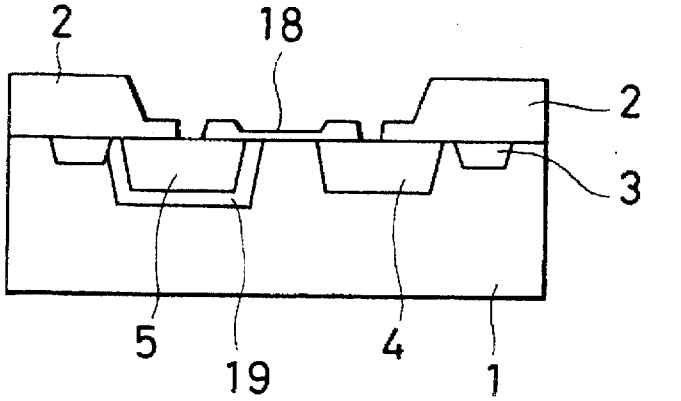

After that, a gate oxide film 18 was formed with a thickness of 100 Å through 1000 Å in the opening portion of the gate region was formed, and the oxide films on the source region 5 and the drain region 4 were removed selectively. As a result, the opening portion for contact were arranged on the drain and source regions as shown in FIG. 4D.

On the opening portion for contact, for forming electrodes, metals such as Al, Al—Si, Al—Cu—Si or the like were deposited by a vacuum evaporation process or a sputtering process. Finally, a source electrode 6, a drain electrode 7 and a gate electrode 8 arranged as electrodes in the mask alignment process and the etching process, thus, a semiconductor circuit as shown in FIG. 3B and FIG. 3C was established.

In addition, in the embodiment described above, the substrate plate with any shape may be used, but the shape of a wafer or plate is preferable. Further, it may be easily understood that this invention can operate even if p-type semiconductors and n-type semiconductors are replaced by one another.

In addition, as shown in the embodiment of the present invention, one of the major advantages in using the MOS transistors in place of diodes is that there is no need to use switches requiring a large amount of driving current in the power supply circuit giving a drain voltage, because, when supplying a current into segments to be controlled, the drain voltage is biased under a normal operational condition and the current flow to the segments may be controlled separately and reliably by controlling an individual gate voltage.

The recording head in the present invention as illustrated by the above description is mounted in an ink jet recording system and driven by an electrically connected drive control circuit in the ink jet recording system so as to form an electric circuit as shown in FIG. 3D and FIG. 3E.

The following is one embodiment of an equipment equipped with the recording head of the present invention.

FIG. 5 through FIG. 9 shows each of an ink jet unit IJU, an ink jet head IJH, an ink tank IT, an ink jet cartridge IJC, a main part of an ink jet recording system iJRA and a carriage HC and their relationship with which the recording head with its structure described above is embodied suitably. In the following descriptions, each component structure of the ink jet recording system is explained with these drawings.

Figure 5:
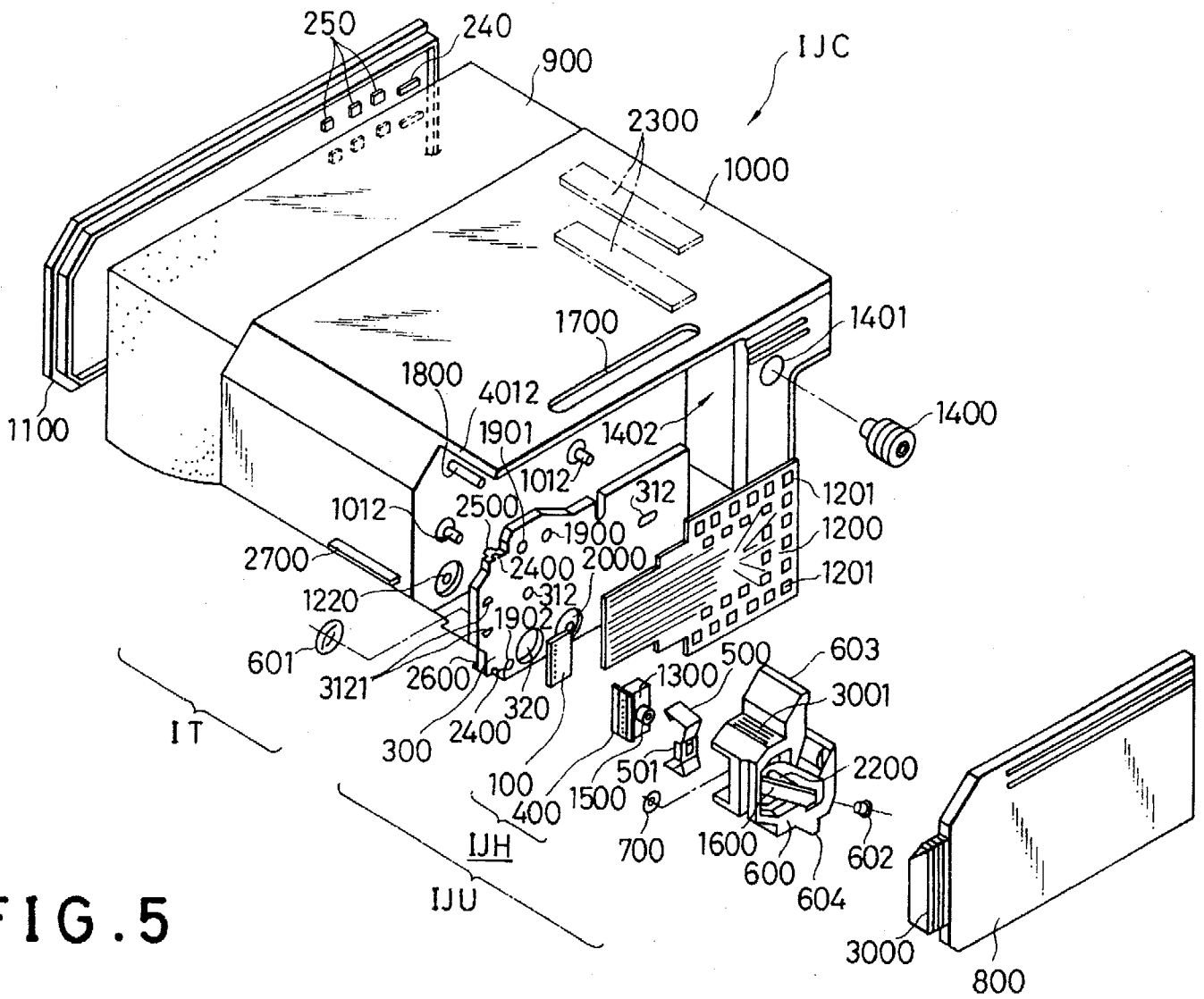
FIG. 5 is an assembly drawing showing an ink jet cartridge using a recording head in accordance with the present invention.
Figure 6:
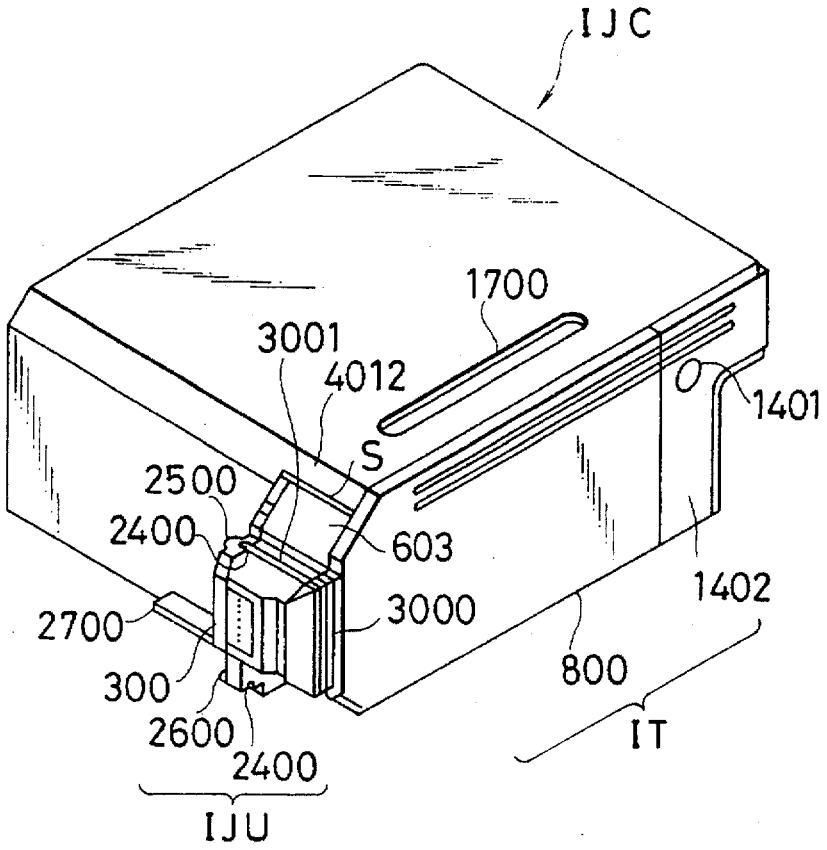
FIG. 6 is a perspective view showing an assembled ink jet cartridge shown in FIG. 5.

The ink jet cartridge IJK in this embodiment, as apparent in FIG. 6, has a large capacity for receiving ink and has such a shape that a portion of an ink jet unit IJU sticks out from the front face of the ink jet tank IT. This ink jet cartridge IJC is fixed and supported by locating means and electric contacts described later, or the carriage HC as shown in FIG. 9 which is mounted in the ink jet recording system IJRA. In addition, this ink jet cartridge is an exchangeable type, that is, it can be set on and detached from the carriage HC. In FIG. 5 through FIG. 9, some inventions arisen in the progress of establishing this invention may be found in the structures of each of the components. Along with brief descriptions of these structures of each components, the overall picture of the ink jet recording system IJRA is disclosed below.

(i) Description of the construction of the ink jet unit IJU

The ink jet unit IJU in this embodiment is a recording unit using an ink ejection mechanism for recording information in terms of characters and visual images, by using electrothermal transducers generating thermal energy to make film boiling take place in the ink in response to input electric signals.

In FIG. 5, reference numeral 100 denotes a heater board or substrate as shown in FIG. 3 and FIG. 4. The heater board 100 is composed of electrothermal transducers (ejection heaters) arranged in an array geometry on a silicon substrate plate and electric wiring supplying power to the transducers formed with a film forming technology. Reference numeral 1200 denotes a distribution substrate connecting to the heater board 100, containing wirings to the heater board 100 (both ends of the wirings, for example, are fixed by wire bonding) and pads 1201 located at one end of the wiring from the heater board for transferring electric signals from the host apparatus of the recording system.

Reference numeral 1300 denotes a top plate with grooves which has separation walls for defining individual ink passages, a common fluid reservoir and so on. The top plate is a molded unit with an ink inlet 1500 for pouring ink supplied from the ink tank IT into the common fluid reservoir and an orifice plate 400. Though the preferable material for the molded unit is polysulfone, another kind of molding resin is acceptable to be used.

Reference numeral 300 denotes a support member, for example, made of metal, supporting the reverse side of the distributing substrate 1200 by meeting their flat faces together, defining a bottom of the ink jet unit IJU. Reference numeral 500 denotes a rebound spring shaped like a letter M. The rebound spring 500 holds the fluid reservoir by pressing it at the center of the letter M and at the same time its apron portion 501 also presses a portion of ink passage. The heater board 100 and the top plate 1300 are held by the rebound spring 500 with its legs penetrated through holes 3121 on the support member 300 and fixed in the reverse side of the support member 300. That is, the heater board 100 and the top plate 1300 are fixed and contacted to each other by the rebound force generated with the rebound spring 500 and its apron portion 501.

The support member 300 has locating holes 312, 1900 and 2000 into which two protruding portions 1012 for locating on the side wall of the ink tank IT and protruding portions 1800 and 1801 for locating and supporting by fusion are inserted. The support member 300 has also protruding portions 2500 and 2600 for locating the carriage HC in the ink jet recording system IJRA in a rear side of the support member 300. In addition, the support member 300 has a hole 320 through which an ink supply pipe 2200 makes it possible to supply ink from the ink tank IT as disclosed later. The distributing substrate 1200 is bound on the support member 300 by bonding materials or the like. There are a couple of concave portions 2400 of the support member 300 in the neighborhood of the locating protruding portions 2500 and 2600. The concave portions are also located on the extension of the line from the apex portion of the recording head, three sides of which are defined by portion—having a plurality of parallel grooves 3000 and 3001, in the ink jet cartridge IJC as shown in FIG. 6. therefore, the support member 300 makes it possible to keep an unfavorable dust and ink sludge away from the protruding portions 2500 and 2600. On the other hand, as illustrated in FIG. 5, a cover plate 800 with the parallel grooves 3000 forms an outer wall of the ink jet cartridge IJC as well as a space for the ink jet unit IJU. In an ink supply member 600 having other parallel grooves 3001 includes an ink pipe 1600 arranged as a cantilever with its end being fixed at the side of the ink supply pipe 2200 and linked continuously to the ink supply pipe. A sealing pin 602 is inserted in the ink supply pipe 2200 in order to establish a capillary action between the fixed end of the ink pipe 1600 and the ink supply pipe 2200. Reference numeral 601 denotes a packing material for sealing the ink tank IT and the ink supply pipe 2200. Reference numeral 700 denotes a filter placed at the end part of the ink supply pipe 2200 and the side of the ink tank IT.

As the ink supply member 600 is made by a molding method, the supply member is attained at a low cost and is finished with correct dimensions in the molding process practically. Further, in the ink supply member 600, owing to the cantilever structure of the ink pipe 1600, it is possible to keep the stable state of pressure welding the ink pipe 1600 onto the ink inlet 1500 in mass production planning. In this embodiment, under the state of pressure welding the ink pipe 1600 onto the ink inlet 1500, only by pouring a sealing bond into the side of the ink inlet 1500 from the side of the ink supply member 600, it is possible to establish a perfect ink flow path without leakage. The method to fix the ink supply member 600 to the support member 300 is described as in the following steps; (1) to put pins (not shown) at the rear side of the ink supply member 600 into holes 1901 and 1902 on the support member 300 and push out the pins through the holes at the other face of the support member 300, and (2) to make bonding the end portion of the pins onto the rear face of the support member 300 by heat fusion method. The end projection of the pins bonded is contained in a concave portion (not shown in drawings) on the surface of the ink tank IT where the ink jet unit IJU is mounted, and then a location of the ink jet unit IJU is fixed correctly with the ink tank IT.

(ii) Description of the structure of the ink tank IT

The ink tank IT is composed of a body of cartridge 1000, an ink absorber 900 and a cover plate 1100. The cover plate 1100 is used to seal the ink absorber 900 after inserting the ink absorber into the body of cartridge 1000 from the opposite face to the face where the ink jet unit IJU is mounted in the body of cartridge.

The ink absorber 900 is used for absorbing ink and is placed in the body of cartridge 1000. Reference numeral 1220 denotes an ink supply inlet for supplying ink to the ink jet unit IJU, comprised of above mentioned components 100 through 600. In addition, the inlet 1220 is also used as an inlet port for pouring ink into the absorber 900 by an ink pouring process prior to mounting the ink jet unit IJU at the portion 1010 of the body of cartridge 1000.

In this embodiment, ink can be supplied into the ink tank IT through either an atmospheric air communication port 1401 or this ink supply inlet 1220. For the purpose of supplying ink into the absorber 900 relatively efficiently and uniformly, it is preferable to supply ink through the ink supply inlet 1220. This is because the empty space only containing air in the ink tank IT, which is formed by ribs 2300 and partial ribs 240 and 250 of the cover plate 1100 in order to attain an efficient ink supply flow from the absorber 900, occupies a corner space communicating with the atmospheric air communication port 1401 and is positioned at a longest distant from the ink supply inlet 1220. This ink supply method is very effective in view of practical use. The rib 2300 comprises four members parallel to the moving line of the carriage HC. The members are arranged on the back end face of the body of cartridge 1000. The rib 2300 prevents the absorber 900 from contacting to the back end face of the body 1000 of the ink tank. The partial ribs 240 and 250 are also placed on the inner surface of the cover plate 1100 positioned on the extension line from the rib 2300. In contrast with the rib 2300, the partial ribs 240 and 250 are composed of many smaller pieces of ribs respectively so that a volume of empty space containing air of the roles 240 and 250 becomes larger than the rib 2300. The partial ribs 240 and 250 are distributed over half or less of the area of the inner face of the cover plate 1100. With these ribs, the flow of ink at the corners of the ink tank IT far from the ink supply inlet 1220 of the absorber 900 is stabilized, the ink can be lead from every region of the absorber 900 into the ink supply inlet 1220 by a capillary action. The atmospheric air communication port 1401 is an open hole on the cover plate 1402 for communicating air between the inner containment of the ink tank IT and the atmosphere. The atmospheric air communication port 1401 is plugged with a repellency material 1400 for preventing ink leakage.

A space of ink containment of the ink tank IT in this embodiment is a rectangular parallelepiped and a longer side of the space is corresponding to the side of the ink tank IT as shown in FIG. 5 and FIG. 6. Hence, the layout of ribs 240 and 250 are effective specifically in this case. In case that the ink tank IT has its longer side in the direction of the movement of the carriage HC or the ink tank IT has the inner containment space in a cube, the flow of ink in the absorber 900 can be stabilized by placing those ribs on the whole area of the inner face of the cover plate 1100.

Figure 7:
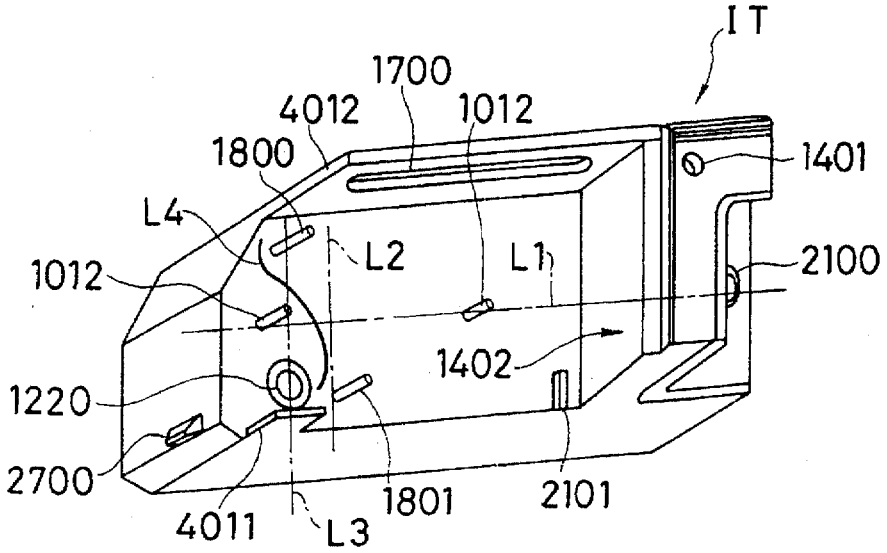
FIG. 7 is a perspective view showing a mounting portion of the ink jet unit shown in FIG. 5.

A structure of the fitting face of the ink tank IT to the ink jet unit IJU is illustrated in the FIG. 7. When a line L1 is taken to be a straight line passing through the center of the ink ejection outlet of the orifice plate 400 and parallel to the bottom face of the ink tank IT or to the reference face on the surface of the carriage on which the ink jet cartridge is mounted, two protruding portions 1012 to be inserted into the hole 312 on the support member 300 are on the line L1. The height of the protruding portions 1012 is a little less than the thickness of the support member 300 and the support member 300 is positioned with the protruding portions 1012. On the extension of the line L1, as shown in FIG. 7, a click 2100 is formed for catching a right angular hook surface 4002 of a locating hook 4001 shown in FIG. 8, so that a force for locating the carriage HC is applied on the surface region parallel to the before mentioned reference face on the surface of the carriage HC including the line L1. This layout relationship between the ink tank and the ink jet cartridge forms an effective structure to make the accuracy of locating the ink tank IT alone equivalent to that of locating the ink ejection outlet of the ink jet head IJH.

In addition, the length of the protruding portions 1800 and 1801 to be inserted in the holes 1900 and 2000 for fixing the support member 300 onto the side wall of the ink tank IT is greater than that of the above mentioned protruding portions 1012. The portions 1800 and 1801 are used for fixing the supporting member on the side wall of the ink tank IT by penetrating through the holes on the support member 300 and by bonding the end part of the protruding portions 1800 and 1801 with a heat fusion method. L3 is a straight line intersecting perpendicularly with the straight line L1 and passing the protruding 1800, and L2 is a straight line intersecting perpendicularly with the straight line L1 and passing the protruding 1801. Because the center of the before mentioned ink supply inlet 1220 is locating nearly on the straight line L3, the protruding portion 1800 works for stabilizing the connection state between the ink supply inlet 1220 and the ink supply pipe 2200 so as to make it possible to reduce the over load on this connection state in case of dropping them and/or giving them shocks. As the straight lines L2 and L3 do not intersect at any point and there are protruding portions 1800 and 1801 in the neighborhood of the protruding portion 1012 at the side of the ink ejection outlet of the ink jet head IJH, the ink tank IT being supported on three points, a supportive effect occurs for locating the ink jet head IJH on the ink tank IT. And a curve L4 illustrated in FIG. 7 shows a position of an outside wall of the ink supply member 600 when installed. As the protruding portions 1800 and 1801 are layed out along the curve L4, it is possible to provide the ink tank IT with enough high strength and dimensional accuracy under the application of the weight load of the top of the ink jet head IJH. A nose flange 2700 of the ink tank IT is inserted into a hole in a front plate 4000 of the carriage HC (shown in FIG. 8) so as to prevent an abnormal state where the displacement of the ink tank IT becomes extremely large. A latchble portion 2101 to be inserted into yet another locating portion of the carriage HC is formed in the ink tank IT.

The ink jet unit IJU is installed inside of the ink tank IT and then is closed with the cover plate 800 so that the ink jet unit is surrounded by the ink tank and the cover plate except an under side opening of the ink tank. However, the under side opening approaches the carriage HC when the ink jet cartridge IJC is mounted on the carriage HC, thereby a substantial perfect closed space around the ink jet unit IJU is established. Accordingly, though the heat generated from the ink jet head IJH within the closed space is valid as forming a heat jacket, during a long time of a continuous use of the ink jet head, the temperature of the closed space increases slightly. In this embodiment, for promoting a natural heat dissipation from the supporting member 300, a slit 1700 with a width less than that of the above-mentioned closed space is formed on the upper deck of the ink jet cartridge IJC. Owing to the slit 1700, it is possible to prevent the temperature rise within the closed space and to establish an uniform temperature distribution in the whole of the ink jet unit IJU being independent of any environmental fluctuation.

By assembling the ink jet cartridge IJC composed of the ink tank IT and the ink jet unit IJU as shown in FIG. 6, ink can be fed from the ink tank into the ink supply member 600 thorough the ink inlet 1220, the hole 320 of the supporting member 300 and an inlet provided on a back face of the ink supply member 600, and after ink flows inside the ink supply member 600, ink pours into a common fluid reservoir through an adequate ink supply tube and the ink inlet 1500 of the top plate 1300 from the ink outlet of the ink supply member 600. Gaps formed at connecting portions of these components for supplying ink described above are filled with packing substance such as a silicone rubber, a butyl rubber or the like for sealing the gaps, and then an ink feed route is established.

In this embodiment, a material used for the top plate 1300 is an ink-resistant synthetic resin such as polysulfone, polyether sulphone, polyphenylene oxide, polypropylene or the like. The top plate 1300 is molded into a single module together with the orifice plate 400.

As described above, as the ink supply member 600, the single module of the top plate 1300 with the orifice plate 400, and the body 1000 of the ink tank are a single module molded respectively, not only a high accuracy in assembling the components for ejecting ink can be attained but also a quality of the components in a mass production is increased effectively. In addition, by assembling individual parts into a single molded component, the number of parts of the ink jet cartridge IJC may be reduced, compared with a conventional assembling method, thereby a favorable and expected features of the ink jet cartridge is established.

Figure 8:
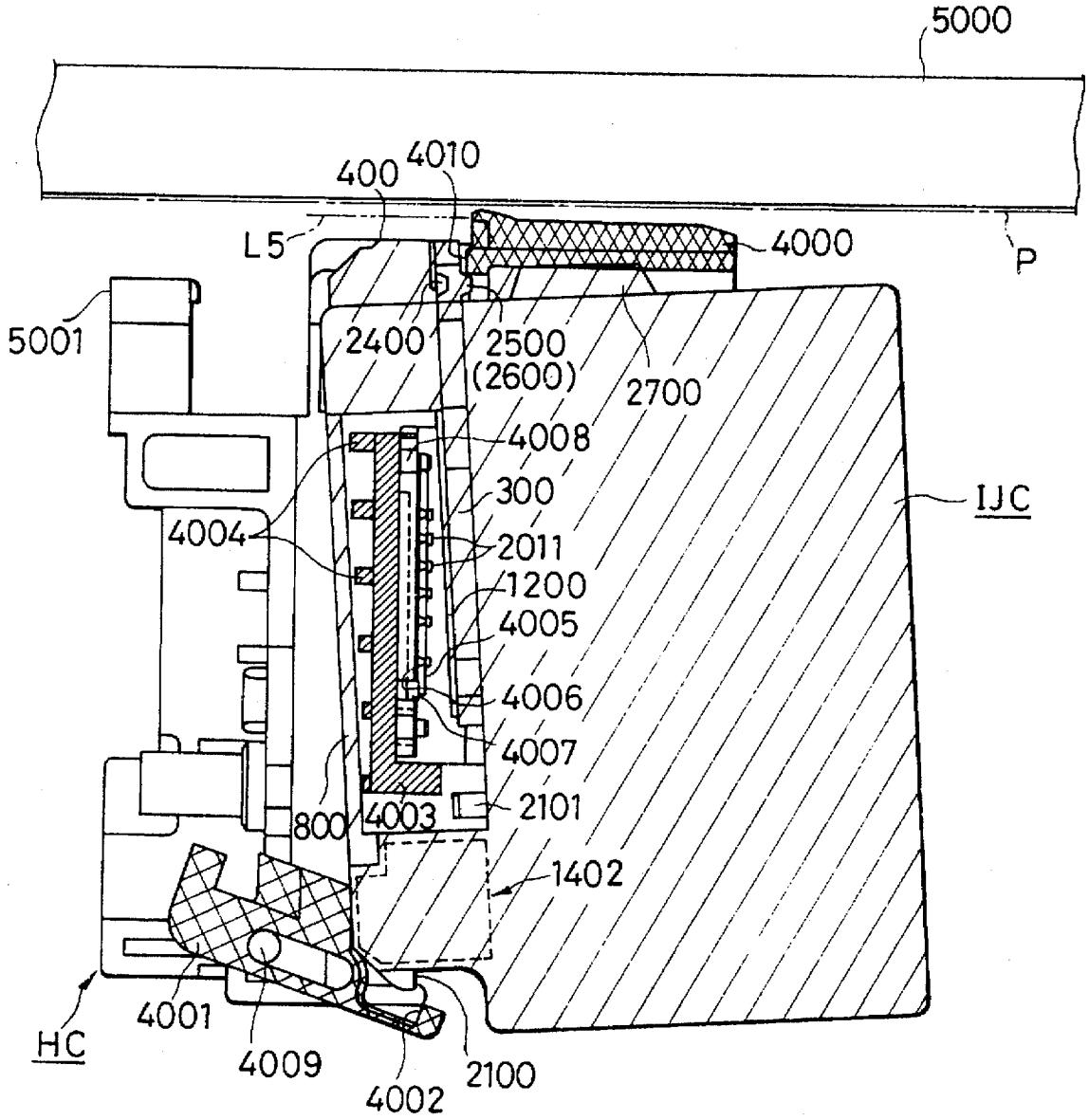
FIG. 8 is a plan view, partly in cross section, showing the ink jet cartridge shown in FIG. 5 mounted in an ink jet recording system in accordance with the present invention.
Figure 9:
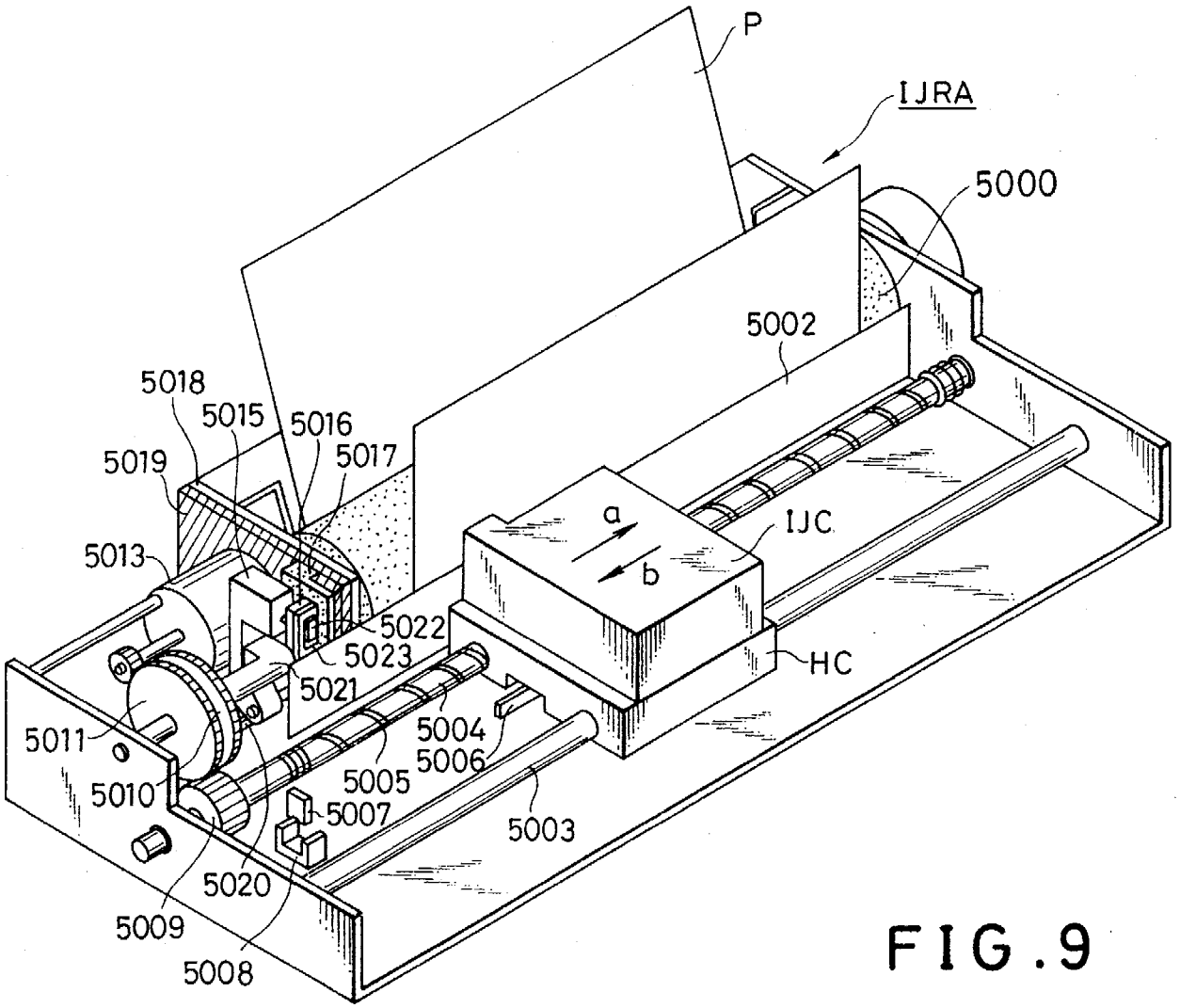
FIG. 9 is a perspective view of an embodiment of an ink jet recording system in accordance with the present invention attached with the ink jet cartridge shown in FIG. 5.

(iii) Description of an installation of the ink jet cartridge IJC onto the carriage HC In FIG. 8, reference numeral 5000 denotes a platen roller for guiding a recording medium P such as a sheet of paper moving in the direction from its lower side to its upper side. The carriage HC moves along the platen roller 5000. The carriage HC has, in a forward area of the carriage HC facing to the platen roller 5000, the front plate 4000 (with a thickness of 2 mm) in front of the ink jet carriage IJC, a flexible sheet 4005 furnished with pads 2011 corresponding to pads 1201 on the distributing substrate 1200 of the ink jet cartridge IJC, a support board 4003 for electrical connection holding a rubber pad 4006 for generating elastic force for pressing the reverse side of the flexible sheet 4005 onto the pads 2011, and the locating hook 4001 for holding the ink jet cartridge IJC on the right position of the carriage HC. The front plate 4000 has two locating protruding surfaces 4010 corresponding to the before mentioned locating protrusions 2500 and 2600 of the support member 300. The locating protruding surfaces 4010 receive a vertical pressure from the ink jet cartridge IJC installed in the carriage HC. The front plate 4000 has a plurality of reinforcing ribs (not shown in drawings) spanning in the direction along the vertical pressure. The surface of these ribs is a little closer by about 0.1 mm to the platen roller 5000 than the position of front surface 1.5 (shown in FIG. 8) of the ink jet cartridge IJC and hence these ribs is used also for protectors of the ink jet head IJH. The support board for electrical connection has a plurality of reinforcing ribs 4004 spanning in the vertical direction to another surface of the ink jet cartridge IJC in contrast to the spanning direction of the above-mentioned reinforcing ribs of the front plate 4000. The protrusion of the ribs 4004 is gradually reduced along the direction from the platen roller side to the hook 4001. This configuration of the ribs 4004 also enables the ink jet cartridge to be positioned with an inclination angle to the platen roller 5000 as shown in FIG. 8. The support board 4003 has a locating surface 4007 on the side of the locating hook 4001 and a locating surface 4008 on the side of the platen roller 5000 for electrical connection stability. The support board 4003 has a pad contact region between these locating surfaces and limits the distortion length of the rubber pad sheet 4006 corresponding to pad 2011 by these locating surfaces. Once the ink jet cartridge IJC is fixed in the right position for recording, the locating surfaces 4007 and 4008 Contact on the surface of the distributing substrate 1200. Moreover, in this embodiment, as pads 1201 of the distributing substrate 1200 are arranged symmetrically with respect to the before mentioned straight line L1, the distortion amount of the pads on the rubber pad sheet 4006 is made to be uniform and then a contacting pressure between the pads 2011 and 1201 is more stabilized. In this embodiment, the pads 1201 are arranged in an array with 2 center rows, 2 upper columns and 2 lower columns.

The locating hook 4001 has a slot linking an fixing axis 4009. Using a movable space in the slot, by rotating the locating hook 4001 counterclockwise from the position shown in the FIG. 8 and moving the locating hook 4001 left along the platen roller 5000, the location of the ink jet cartridge IJC can be fixed relative to the carriage HC. Though any means for moving the locating hook 4001 may be used, a moving mechanism with a lever or the like is suitable for moving the locating hook. The following is a further detailed and stepwise description about fixing the ink jet cartridge IJC into the carriage HC. (1) At first, in response to the rotating movement of the locating hook 4001, the ink jet cartridge IJC moves to the side of the platen roller 5000 and at the same time the locating protrusions 2500 and 2600 move to the position where they can contact the locating protruding surface 4010 of the front plate 4000. (2) Next, by the movement of the locating hook 4001 in the left direction, a rectangular surface of the hook surface 4002 well contacts a rectangular surface of the click 2100 and at the same time the locating hook 4001 rotates horizontally around the contacting of the locating components 2500 and 4010, and then as a result the pads 1201 and 2011 contact closely to each other. (3) The locating hook 4001 is held in a fixed position, thereby a perfect contacting state between the pads 1201 and 2011, a perfect contacting state between the locating protrusions 2500 and 4010, a facial contacting state between the rectangular surface of the hook surface 4002 and the click 2100 and a face contacting state between the distributing substrate 1200 and the locating surfaces 4007 and 4008 of the support board 4003 are established at the same time, and then the fixing of the ink jet cartridge into the carriage HC is established finally.

(iv) Summarized description of a body of the ink jet recording system

FIG. 9 illustrates schematically an embodiment of an ink jet recording apparatus IJRA to which the present invention is applied. A pin arranged in the carriage HC meshes with a screw channel 5005 of a lead screw axis 5004 rotated reversibly by the torque transmitted through driving gears 5011, 5010 and 5009 from a driving motor 5013. As the driving motor 5013 rotates clockwise or counterclockwise, simultaneously the lead screw axis 5004 rotates in the same manner. The carriage HC moves in the either direction of the arrow a or b as shown in FIG. 9 as the lead screw axis 5004 rotates clockwise or counterclockwise. Reference numeral 5002 denotes a paper keep plate for pressing a paper sheet P as a recording medium against the platen roller 5000 along the moving direction of the carriage HC. Reference numerals 5007 and 5008 denote photocouplers, which generate a signal to indicate that the carriage HC is in a home position by sensing an existence of a lever 5006 in the region where photocouplers are placed. The signal is used to change the turning direction of the motor 5013 and so on. Reference numeral 5016 denotes a supporting member for support a capping member 5022 which is used to cap the front side of the ink jet head IJH. Reference numeral 5015 denotes a suction means for absorbing ink inside the capping member 5022 from an aperture 5023 within the capping member so as to recover and increase the ink ejection power of the ink jet head IJH. Reference numeral 5017 denotes a cleaning blade. Reference numeral 5019 denotes a member for enabling the cleaning blade 5017 to move forward or backward and supported by a body supporting plate 5018. As for another embodiment of the cleaning blade 5017, there is no need to say that other types of cleaning blades as used in prior art are applicable to the present embodiment. In addition, a lever 5021 used for starting to recover an absorbing ability moves in accordance with the movement of a cam 5020 meshing the carriage HC and this movement is controlled by a torque transmission means as used in prior art such as means for switching a clutch by a driving force from the driving motor 5013. In order to perform capping, cleaning and absorption restoration operations, a controller for actuating them are formed so that expanded tasks regarding the above mentioned operations may be performed at an appropriate timing and at their right positions controlled by the rotation of the lead screw axis 5004 when the carriage HC arrives at its home position.

Further, the ink jet recording system shown in FIG. 9 can be preferably realized as a portable or handy printer, since the ink jet cartridge IJC is compact.

(v) Various Aspects of the Invention

The present invention is particularly suitably useable in an ink jet recording head having thermal energy means for producing thermal energy as energy used for ink ejection such as a plurality of electrothermal transducers, a laser apparatus for generating a plurality of laser beams or the like and a recording apparatus using the head. The thermal energies cause variation of the ink condition and thereby eject ink. This is because, the high density of the picture element, and the high resolution of the recording are possible.

The typical structure and the operational principles are preferably those disclosed in U.S. Pat. Nos. 4,723,129 and 4,740,796. The principle is applicable to a so-called on-demand type recording system and a continuous type recording system particularly however, it is suitable for the on a demand type because the principle is such that at least one driving signal is applied to an electrothermal transducer disposed on liquid (ink) retaining sheet or inkpassage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Patent Application Laying-open No. 123670/1984 wherein a common slit is used as the ejection outlet for plurality electrothermal transducers, and to the structure disclosed in Japanese Patent Application Laying-open No. 138461/1984 wherein an opening for absorbing pressure waves of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plurality of recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or suction means, preliminary heating means by the ejection electrothermal transducer or by a combination of the ejection electrothermal transducer and additional heating element and means for preliminary ejection not for the recording operation, which can stabilize the recording operation.

As regards the kinds and the number of the recording heads mounted, a single head corresponding to a single color ink may be equipped, or a plurality of heads corresponding respectively to a plurality of ink materials having different recording colors and densities may be equipped. The present invention is effectively applicable to an apparatus having at least one of a monochromatic mode solely with a main color such as black and a multi-color mode with different color ink materials or a full-color mode by color mixture. The multi-color or full-color mode may be realized by a single recording head unit having a plurality of heads formed integrally or by a combination of a plurality of recording heads.

Furthermore, in the foregoing embodiment, the ink has been liquid. It may, however, be an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state or the ink material is solidified when it is unused is effective to prevent the evaporation of the ink. In either of the cases, with the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material is through holes or recesses formed in a porous sheet as disclosed in Japanese Patent Application Laying-open No. 56847/1979 and Japanese Patent Application Laying-open No. 71260/1985. The sheet is faced to the electrothermal transducers. The most effective one for the ink materials described above is the film boiling system.

The ink jet recording apparatus may be used as an output means of various types of information processing apparatuses such as a work station, personal or host computer, a word processor, a copying apparatus combined with an image reader, a facsimile machine having functions for transmitting and receiving information, or an optical disc apparatuses for recording and/or reproducing information into and/or from an optical disc. These apparatuses require means for outputting processed information in the form of hard copy.

Figure 10:
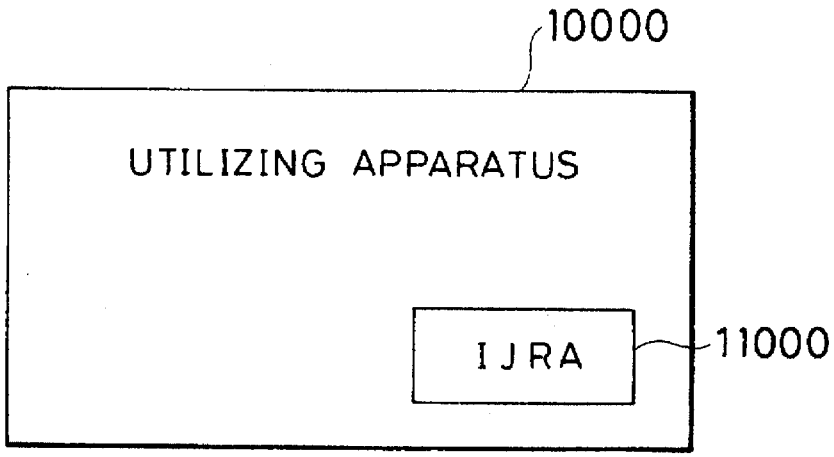
FIG. 10 is a schematic diagram illustrating an embodiment of an apparatus in accordance with the present invention to which the ink jet recording system shown in FIG. 9 is equipped.

FIG. 10 schematically illustrates one embodiment of a utilizing apparatus in accordance with the present invention to which the ink jet recording system shown in FIG. 9 is equipped as an output means for outputting processed information.

In FIG. 10, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIG. 9. The ink jet recording apparatus (IJRA) 11000 receives processed information from the utilizing apparatus 10000 and provides a print output as hard copy under the control of the utilizing apparatus 10000.

Figure 11:
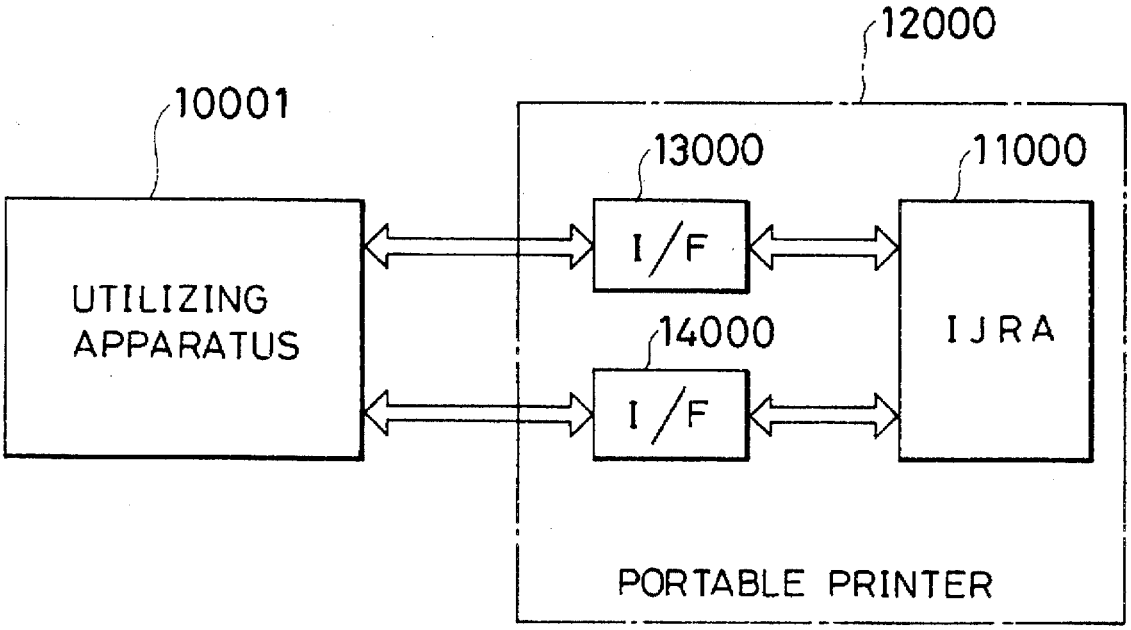
FIG. 11 is a schematic drawing illustrating an embodiment of a portable printer in accordance with the present invention.

FIG. 11 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 11, reference numeral 10001 schematically denotes such a utilizing apparatus. Reference numeral 12000 schematically denotes a portable printer having the ink jet recording apparatus (IJRA) 11000 shown in FIG. 9 incorporated thereinto and interface circuits 13000 and 14000 receiving information processed by the utilizing apparatus 11001 and various controlling data for controlling the ink jet recording apparatus 11000, including hand shake and interruption control from the utilizing apparatus 11001. Such control per se is realized by conventional printer control technology.

Although specific embodiments of a record apparatus constructed in accordance with the present invention have been disclosed, it is not intended that the invention be restricted to either the specific configurations or the uses disclosed herein. Modifications may be made in a manner obvious to those skilled in the art.

For example, although the embodiments are described with regard to a serial printer, the present invention can also be applied to line printers. Here, the serial printer is defined as a printer that has a moving member on which the record head is mounted, the moving member being moved to and from in the direction perpendicular to the transporting direction of the recording paper. Accordingly, it is intended that the invention be limited only by the scope of the appended claims.

The invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A substrate for an ink jet recording head, comprising:

a substrate plate, said substrate plate having a first conduction type semiconductor of a low impurity concentration;

a plurality of electrothermal transducers for generating energies to be applied to an ink, each of said plurality of electrothermal transducer having a pair of wiring electrodes electrically connected to that said electrothermal transducer;

a plurality of functional devices, each said functional device being electrically connected to a one of said electrothermal transducers to drive that said one electrothermal transducer, said one electrothermal transducer and said functional device being formed commonly on or in said substrate plate, each of said plurality of functional devices including:

a pair of major electrode regions arranged to be separated from each other in said substrate plate, said pair of major electrode regions being composed of a second conduction type semiconductor and having a lower-side;

a control electrode region so arranged to surround a lower-side of one of said pair of major electrode regions, and said control electrode being composed of a first conduction type semiconductor of a higher impurity concentration than the impurity concentration of said substrate plate;

a first insulating layer arranged on said control electrode region and having a film thickness of 100 Å to 1000 Å; and a second insulating layer arranged on a region other than said region on which said first insulating layer is arranged and having a film thickness of at least 5000 Å, wherein said one of said major electrode regions is electrically connected to one of said pairs of said wiring electrodes, the other major electrode region being used for a high voltage as compared with said one of said major electrode regions, said plurality of electrothermal transducers being driven by electric signals that flow between said pairs of major electrode regions.

2. A substrate as claimed in claim 1, further comprising a guard ring region disposed between said functional devices, said guard ring regions having the same conduction type semiconductor as that of said substrate plate and having a higher impurity concentration than the impurity concentration of said substrate plate.

3. A substrate as claimed in claim 2, wherein said plurality of energy generating members are for generating thermal energies in correspondency with driving signals from said plurality of functional devices, said thermal energies causing film boiling in ink.

4. A substrate as claimed in claim 1, wherein said plurality of energy generating members are provided to generate thermal energies in correspondency with driving signals from said plurality of functional devices, said thermal energies causing film boiling in ink.

5. A recording head comprising:

a fluid ejection outlet part including an ink ejection outlet; and a substrate comprising:

a substrate plate having a first conduction type semiconductor of a low impurity concentration;

a plurality of electrothermal transducers for generating energies to be applied to an ink in said ejection outlet part, each of said plurality of electrothermal transducers having a pair of wiring electrodes electrically connected to that said electrothermal transducer;

a plurality of functional devices, each of said functional devices being electrically connected to a one of said electrothermal transducers for driving said one electrothermal transducer, each said electrothermal transducer and said functional device being formed commonly on or in said substrate plate, each of said plurality of functional devices including;

a pair of major electrode regions arranged to be separated from each other in said substrate plate, said pair of major electrode regions being composed of a second conduction type semiconductor and having a lower-side;

a control electrode region so arranged to surround a lower-side of one of said pair of major electrode regions, and said control electrode being composed of a first conduction type semiconductor of a higher impurity concentration than the impurity concentration of said substrate plate;

a first insulating layer arranged on said control electrode region and having a film thickness of 100 Å to 1000 Å; and a second insulating layer arranged on a region other than said region on which said first insulating layer is arranged and having a film thickness of at least 5000 Å;

wherein said one of said major electrode regions is electrically connected to one of said pairs of said wiring electrodes, the other major electrode region being used for a high voltage as compared with said one of said major electrode regions, said plurality of electrothermal transducers being driven by electric signals that flow between said pairs of major electrode regions.

6. A recording head as claimed in claim 5, further comprising a guard ring region disposed between said functional devices, said guard ring region having the same conduction type semiconductor as that of said substrate plate and having a higher impurity concentration than the impurity concentration of said substrate plate.

7. A recording head as claimed in claim 6, wherein said plurality of energy generating members are for generating thermal energies in correspondency with driving signals from said plurality of functional devices, said thermal energies cause film boiling in ink and thereby eject ink from said ink ejection outlet.

8. A recording head as claimed in claim 6, wherein each of said control electrodes of said plurality of functional devices is grounded.

9. A recording head as claimed in claim 5, wherein said plurality of energy generating members are for generating thermal energies in correspondency with driving signals from said plurality of functional devices, said thermal energies cause film boiling in ink and thereby eject ink from said ink ejection outlet.

10. A recording head as claimed in claim 5, wherein each of said control electrodes of said plurality of functional devices is grounded.

11. An ink jet recording system comprising:

a recording head having a substrate and a fluid ejection outlet part including an ink ejection outlet, said substrate including;

a substrate plate having a first conduction type semiconductor of a low impurity concentration;

a plurality of electrothermal transducers for generating energies to be applied to the ink in said ejection outlet part, each of said plurality of electrothermal transducers having a pair of wiring electrodes electrically connected to that said electrothermal transducer;

a plurality of functional devices, each said functional device being electrically connected to a one of said electrothermal transducers to drive that said electrothermal transducer, said one electrothermal transducer and said functional device being formed commonly on or in said substrate plate, each of said plurality of functional devices including;

a pair of major electrode regions arranged to be separated from each other in said substrate plate, said pair of major electrode regions being composed of a second conduction type semiconductor and having a lower-side;

a control electrode region so arranged to surround a lower-side of one of said pair of major electrode regions, and said control electrode being composed of a first conduction type semiconductor of a higher impurity concentration than the impurity concentration of said substrate plate;

a first insulating layer arranged on said control electrode region and having a film thickness of 100 Åto 1000 Å; and a second insulating layer arranged on a region other than said region on which said first insulating layer is arranged and having a film thickness of at least 5000 Å;

wherein said one of said major electrode regions is electrically connected to one of said pairs of said wiring electrodes, the other major electrode region being used for a high voltage as compared with said one of said major electrode regions, said plurality of electrothermal transducers being driven by electric signals that flow between said pairs of major electrode regions;

ink feed means for supplying ink into said recording head; and transport means for carrying a recording medium to a recording position of said recording head.

12. An ink jet recording system as claimed in claim 11, further comprising a guard ring region disposed between said functional devices, said guard ring region having the same conduction type semiconductor as that of said substrate plate and having a higher impurity concentration than the impurity concentration of said substrate plate.

13. An ink jet recording system as claimed in claim 12, wherein said plurality of energy generating members are for generating thermal energies in correspondency with driving signals from said plurality of functional devices, said thermal energies cause film boiling in ink and thereby eject ink from said ink ejection outlet.

14. An ink jet recording system as claimed in claim 12, wherein each of said control electrodes of said plurality of functional devices is grounded.

15. An ink jet recording system as claimed in claim 11, wherein said plurality of energy generating members are for generating thermal energies in correspondency with driving signals from said plurality of functional devices, said thermal energies cause film boiling in ink and thereby eject ink from said ink ejection outlet.

16. An ink jet recording system as claimed in claim 11, wherein each of said control electrodes of said plurality of functional devices is grounded.

17. A method of fabricating a substrate for a recording head, said substrate including a substrate plate; a plurality of electrothermal transducers for generating energies to be applied to an ink, each of said plurality of electrothermal transducers having a pair of wiring electrodes electrically connected to that said electrothermal transducer; and a plurality of functional devices, each said functional device being electrically connected to a one of said electrothermal transducers to drive that said one electrothermal transducer, said one electrothermal transducer and said functional device being formed commonly on or in said substrate plate, said method comprising the steps of:

preparing said substrate plate, said substrate plate having a first conduction type semiconductor of a low impurity concentration;

forming a high impurity concentration region of said first conduction type in said substrate plate, said high impurity concentration region having a higher impurity concentration than the impurity concentration of said substrate plate;

forming a pair of major electrode regions of a second conduction type semiconductor in said higher impurity concentration region and at a position remote from said high impurity concentration region in said substrate plate;

providing a control electrode between said pair of major electrodes by forming said pair of major electrodes;

forming a first insulating layer on said control electrode, said first insulating layer having a film thickness of 100 Å to 1000 Å;

forming a second insulating layer arranged on a region other than said region on which said first insulating layer is arranged and having a film thickness of at least 5000 Å;

forming a wiring electrode for controlling a current flowing between said pair of major electrodes by applying a control voltage to said control electrode region through said insulating layer; and connecting each pair of major electrode regions to one of said pairs of wiring electrodes electrically connected to said plurality of electrothermal transducers.

18. A method as claimed in claim 17, further comprising the step of forming a guard ring region between said functional devices, said guard ring region having the same conduction type semiconductor as that of said substrate plate and having a higher impurity concentration than the impurity concentration of the substrate plate.

19. A method as claimed in claim 18, wherein said plurality of energy generating members are provided to generate thermal energies in correspondency driving signals from said plurality of functional devices, said thermal energies causing film boiling.

20. A method as claimed in claim 18, wherein said higher impurity concentration region and said major electrode region formed in said higher impurity concentration region are formed by a double diffusion process.

21. A method as claimed in claim 17, wherein said plurality of energy generating members are for generating thermal energies in correspondency with driving signals from said plurality of functional devices, said thermal energies causing film boiling.

22. A method as claimed in claim 17, wherein said higher impurity concentration region and said major electrode region formed in said higher impurity concentration region are formed by a double diffusion process.

* * * * *

UNITED STATES PATENT AND TRADEMARK OFFICE

CERTIFICATE OF CORRECTION

PATENT NO. : 5,666,142

DATED : September 9, 1997

INVENTOR(S) : KEI FUJITA ET AL.

It is certified that error appears in the above-identified patent and that said Letters Patent is hereby corrected as shown below:

ON THE TITLE PAGE:

[56] REFERENCES CITED

U.S. Patent Documents

| | | | |
|---|---|---|---|
| Insert: | --4,246,593 | 1/1981 | Bartlett--. |
| Insert: | --4,723,129 | 2/1988 | Endo et al.--. |
| Insert: | --4,740,796 | 4/1988 | Endo et al.--. |
| Insert: | --4,463,359 | 7/1984 | Ayata et al.--. |
| Insert: | --4,345,262 | 8/1982 | Shirato et al.--. |
| Insert: | --4,313,124 | 1/1982 | Hara--. |
| Insert: | --4,558,333 | 12/1985 | Sugitani et al.--. |
| Insert: | --4,459,600 | 7/1984 | Sato et al.--. |

Foreign Patent Documents

| | | | |
|---|---|---|---|
| Insert: | --59-123670 | 7/1984 | Japan--. |
| Insert: | --59-138461 | 8/1984 | Japan--. |
| Insert: | --57-72867 | 5/1982 | Japan--. |
| Insert: | --60-71260 | 4/1985 | Japan--. |
| Insert: | --54-56847 | 5/1979 | Japan--. |

UNITED STATES PATENT AND TRADEMARK OFFICE

CERTIFICATE OF CORRECTION

PATENT NO. : 5,666,142

DATED : September 9, 1997

INVENTOR(S) : KEI FUJITA ET AL.

It is certified that error appears in the above-identified patent and that said Letters Patent is hereby corrected as shown below:

COLUMN 2

Line 28, "occurs" should be deleted, and "current." should read --current occurs.--.

COLUMN 3

Line 14, Close up right margin.
Line 15, Close up left margin, and "part; a" should read --part; ¶ a--.
Lines 52-57, "The plurality of energy ... ink ejection outlet." should be deleted.

COLUMN 4

Lines 25-32, "The plurality of energy ... may be grounded." should be deleted.
Line 40, "outlet" should read --outlet;--. (2nd occur.)
Line 47, "members" should read --members,--.

COLUMN 5

Lines 21-26, "The plurality of energy ... ink ejection outlet." should be deleted.

COLUMN 6

Lines 6-14, "The plurality of energy ... double diffusion process." should be deleted.

UNITED STATES PATENT AND TRADEMARK OFFICE

CERTIFICATE OF CORRECTION

PATENT NO. : 5,666,142

DATED : September 9, 1997

INVENTOR(S) : KEI FUJITA ET AL.

It is certified that error appears in the above-identified patent and that said Letters Patent is hereby corrected as shown below:

COLUMN 8

Line 8, "and" should be deleted.
Line 28, "substrate; the" should read --substrate; ¶ the--.
Line 56, "and" should be deleted.

COLUMN 9

Line 34, "region; and control" should read --region; ¶ control--.

COLUMN 10

Line 15, "and" should be deleted.
Line 62, "and" should be deleted.

COLUMN 11

Line 22, "precess," should read --process,--.

COLUMN 14

Line 10, "be" should be deleted.
Line 29, "value" should be deleted.
Line 45, "P′" should read --P⁻--.

UNITED STATES PATENT AND TRADEMARK OFFICE

CERTIFICATE OF CORRECTION

PATENT NO. : 5,666,142

DATED : September 9, 1997

INVENTOR(S) : KEI FUJITA ET AL.

It is certified that error appears in the above-identified patent and that said Letters Patent is hereby corrected as shown below:

COLUMN 15

Line 4, "implantion" should read --implanted--.
Line 21, "The" should read --the--.

COLUMN 16

Line 17, "iJRA" should read --IJRA--.
Line 32, "arisen" should read --which have arisen--.

COLUMN 18

Line 11, "cartridge." should read --cartridge 1000.--.

COLUMN 19

Line 32, "locating" should read --located--.

COLUMN 20

Line 7, "an" should read --a--.
Line 13, "thorough" should read --through--.
Line 39, "features" should read --feature--.
Line 67, "is" should read --are--.

COLUMN 21

Line 17, "Contact" should read --contact--.
Line 27, "an" should read --a--.
Line 44, "well" should be deleted.

UNITED STATES PATENT AND TRADEMARK OFFICE

CERTIFICATE OF CORRECTION

PATENT NO. : 5,666,142

DATED : September 9, 1997

INVENTOR(S) : KEI FUJITA ET AL.

It is certified that error appears in the above-identified patent and that said Letters Patent is hereby corrected as shown below:

COLUMN 22

Line 13, "support" should read --supporting--.
Line 33, "are" should read --is---.
Line 57, "system particularly" should read --system. Particularly--.
Line 58, "on a demand" should read --on-demand--.
Line 60, "on" should read --on a--, and "inkpassage" should read --ink passage--.

COLUMN 23

Line 19, "for" should read --for a--.

COLUMN 24

Line 16, "is" should read --in--.

COLUMN 25

Line 18, "invention," should read --intention,-- (2nd occur.)
Line 29, "transducer" should read --transducers--.
Line 31, "transducer;" should read --transducer; and--.
Line 67, "regions" should read --region--.

COLUMN 26

Line 24, "transducer;" should read --transducer; and--.
Line 32, "including;" should read --including:--.

UNITED STATES PATENT AND TRADEMARK OFFICE

CERTIFICATE OF CORRECTION

PATENT NO. : 5,666,142

DATED : September 9, 1997

INVENTOR(S) : KEI FUJITA ET AL.

It is certified that error appears in the above-identified patent and that said Letters Patent is hereby corrected as shown below:

COLUMN 27

Line 32, "including;" should read --including:--.
Line 45, "100 Åto" should read --100 Å to--.

COLUMN 29

Line 1, "driving" should read --with driving--.

Signed and Sealed this

Seventh Day of July, 1998

Bruce Lehman

*Attest:*

BRUCE LEHMAN

*Attesting Officer*

*Commissioner of Patents and Trademarks*